United States Patent [19]

Masuda

[11] Patent Number: 4,561,765

[45] Date of Patent: Dec. 31, 1985

[54] IMAGE FORMING APPARATUS

[75] Inventor: Shunichi Masuda, Kawasaki, Japan

[73] Assignee: Canon Kabushiki Kaisha, Tokyo, Japan

[21] Appl. No.: 461,010

[22] Filed: Jan. 26, 1983

[30] Foreign Application Priority Data

| | | | |
|---|---|---|---|
| Feb. 1, 1982 | [JP] | Japan | 57-13283 |
| Feb. 1, 1982 | [JP] | Japan | 57-13284 |
| Mar. 24, 1982 | [JP] | Japan | 57-45649 |
| Mar. 24, 1982 | [JP] | Japan | 57-45650 |
| Mar. 24, 1982 | [JP] | Japan | 57-45651 |
| Mar. 24, 1982 | [JP] | Japan | 57-45652 |
| Mar. 24, 1982 | [JP] | Japan | 57-45653 |

[51] Int. Cl.[4] ..... G03G 15/00

[52] U.S. Cl. ..... 355/14 SH; 355/3 SH; 271/288

[58] Field of Search ..... 355/14 SH, 3 SH, 14 R, 355/3 R, 77, 24; 271/3.1, 4, 288, 289, 290

[56] References Cited

U.S. PATENT DOCUMENTS

| | | | |
|---|---|---|---|
| 4,214,831 | 7/1980 | Reesen | 355/24 X |
| 4,419,007 | 12/1983 | Kingsley | 355/14 SH |
| 4,456,236 | 6/1984 | Buddendeck | 355/14 SH X |
| 4,462,681 | 7/1984 | Aerts et al. | 355/14 SH |

*Primary Examiner*—A. C. Prescott

*Attorney, Agent, or Firm*—Fitzpatrick, Cella, Harper & Scinto

[57] ABSTRACT

An image forming apparatus, such as copier, is capable of changing the feed path of original documents according to the imaging mode for achieving efficient original feeding. The apparatus is provided with indicators for indicating the inserting position for the original documents according to the imaging mode.

11 Claims, 28 Drawing Figures

| FIG. 6A | FIG. 6B |
|---|---|

| FIG. 8A | FIG. 8B | FIG. 8C |
|---|---|---|

| | |
|---|---|
| FIG. 9A | |
| FIG. 9B | |
| FIG. 9C | |

| FIG. 12A | FIG. 12B |
|---|---|

IMAGE FORMING APPARATUS

BACKGROUND OF THE INVENTION

1. Field of the Invention

The present invention relates to an image forming apparatus such as a copier or a laser beam printer, provided with attachment devices such as an automatic document feeder for automatically feeding original documents to an exposure position, or a sorter for sorting and collating the recording sheets after image formation.

2. Description of the Prior Art

There is already known an image forming apparatus such as a copier, used in combination with attachment devices such as an automatic document feeder for feeding original documents to an exposure position, and a sorter for sorting and collating the recording sheets after image formation.

Certain automatic document feeders to be used in combination with a two-side copier can handle both originals having images on one side only and originals having images on both sides, and in such automatic document feeders the original document is circulated to an original inserting tray and is inverted by an inverting device in the circulating path to achieve automatic copying of both sides of the original document. However, in case of making plural two-side copies, for example n copies, from an original document, such circulating system has to transport the original document 2n times to the exposure station, thus causing damage in the original document and requiring an extremely long time for the copying operation.

Also certain automatic document feeders are provided with different original inserting trays for one-side copying and two-side copying. In such feeders the operator may insert the original document in a wrong tray, thus inducing an erroneous copying operation.

Also in case a sorter is attached to a copier, the operator often does not notice an abnormality in the density or position of the image on the recording sheet, occuring in the course of a copying operation with the sorter and can find such abnormality only when the recording sheets are taken out from the sorter. Such abnormality is less apt to be noticed particularly when the recording sheets are kept with their faces downward in the sorter.

Furthermore, in such image forming apparatus with an automatic document feeder, the operator often overlooks an abnormality of inclined image or partially lacking image caused by a defective feeding of the original document.

Such situation, if not attended immediately, is undesirable in terms of economy and efficiency of the office jobs.

However, in such situation, the operator has to remove the defective recording sheets one by one from the storage bins of the sorter and has to suitably dispose of the removed recording sheets.

In case of copying important documents, such defective copies cannot be merely thrown into a trash box but have to be brought for example to a shredder.

SUMMARY OF THE INVENTION

An object of the present invention is to provide an image forming apparatus provided with attachment devices which are not associated with the aforementioned drawbacks but allow easy use.

Another object of the present invention is to provide an image forming apparatus provided with attachment devices capable of efficient original feeding by changing the feed path of the original documents according to the operating mode.

Still another object of the present invention is to provide an image forming apparatus provided with attachment devices capable of indicating the inserting position for the original documents according to the operating mode.

Still another object of the present invention is to provide an image forming apparatus provided with attachment devices, allowing the operator to confirm the image formed on the recording sheet transported to the attachment devices, thereby enabling an early discovery of an eventual abnormality in the formed image.

Still another object of the present invention is to provide an image forming apparatus provided with attachment devices, capable of disposing of the unnecessary recording sheets transported to the attachment devices without any trouble to the operator.

The foregoing and still other objects of the present invention will become fully apparent from the following description.

DETAILED DESCRIPTION OF THE PREFERRED EMBODIMENTS

Now the present invention will be clarified in detail by the following description to be taken in conjunction with the attached drawings.

Figure 1:
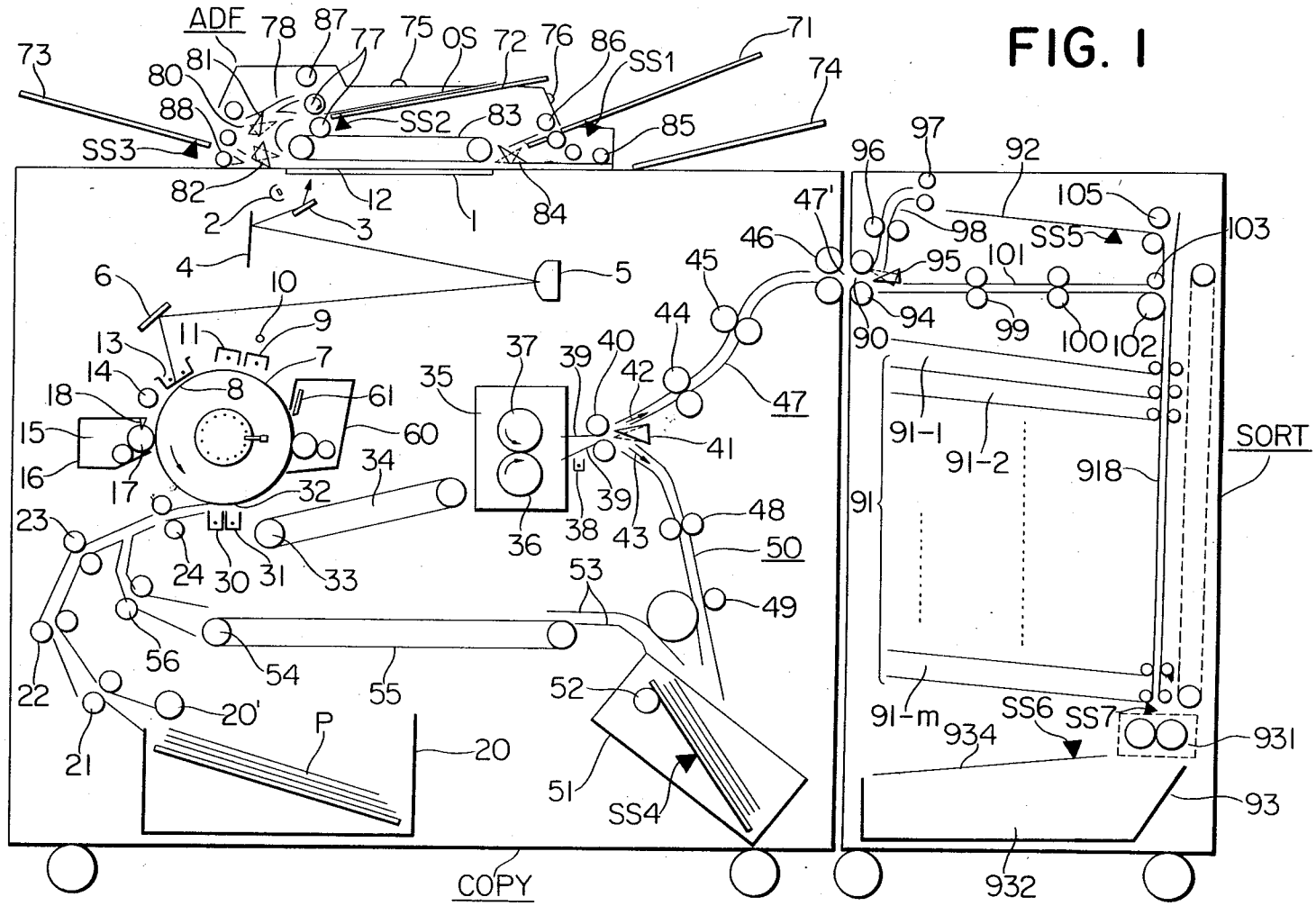
FIG. 1 is a cross-sectional view showing an embodiment of the present invention.

FIG. 1 shows an electrophotographic copier utilizing a toner development process and provided with an automatic document feeder representing an embodiment of the present invention. In the main body COPY of the copier, there is provided an original supporting transparent plate 1 on which an original document to be copied is placed at a reference exposure position. Under said plate 1 there are provided an original illuminating lamp 2, movable mirrors 3, 4 a fixed in-mirror lens 5, a mirror 6 and a photosensitive drum 7. In response to the actuation of a copying button provided in an unrepresented control panel, the photosensitive drum 7 starts to rotate counterclockwise as shown by an arrow and is subjected to electrostatic charging and to light irradiation by chargers and lamps to be explained later. Simultaneously the original illuminating lamp 2 and movable mirrors 3, 4 constituting movable parts of the optical system move to the solidlined positions. Upon completion of a determined amount of rotation of the photosensitive drum 7, there is initiated an exposure step, in which the illuminating lamp 2 and the movable mirror 3 are moved to the right at a speed identical with the peripheral speed of the photosensitive drum 7 while the movable mirror 4 is moved to the right at half speed. An image of the original document thus illuminated by the lamp 2 is therefore focused, through the optical system composed of the movable mirrors 3, 4 in-mirror lens 5 and mirror 6, onto the photosensitive drum 7 in an exposure station 8. Upon completion of a determined amount of exposure corresponding to the size of a recording sheet, the illuminating lamp 2 and movable mirrors 3, 4 terminate the rightward displacement and initiate returning movement to the left. The above-described procedure is repeated according to the number of copies instructed in advance by unrepresented copy number keys provided in the control panel. Upon completion of exposures of the preselected number, the illuminating lamp 2 and movable mirrors 3, 4 return to and stop at the solid-lined positions. The moving speed of the illuminating lamp 2 etc., to the left is made larger than that to the right in order to improve the copying efficiency.

The photosensitive drum 7 is provided with a photosensitive layer and further with a transparent insulating layer thereon, and is rotated counterclockwise as explained before. In the course of said rotation, said drum 7 is at first subjected to an AC charge elimination by an AC pre-charge eliminater 9 receiving an AC high-voltage current from an unrepresented power source, simultaneously with a light irradiation by a lamp 10 in order to erase the charge on said insulating layer and that in the photosensitive layer. Subsequently said drum is charged positively by a primary charger 11 receiving a high-voltage current from a high-voltage power source. Upon arrival of the positively charged portion at the exposure station 8 by further rotation, the drum is subjected to slit exposure of the image transmitted from the illuminating unit 12, simultaneously with an AC charge elimination by an AC charge eliminator 13 receiving an AC high-voltage current from the high-voltage power source. Subsequently the drum is uniformly exposed to the light from a lamp 14 to form an electrostatic latent image on said drum. Said image then enters a developing unit 15. The unit 15, provided with a container 16 for the developer, a developing roller 17 and a blade 18 and renders said latent image on the photosensitive drum 7 visible by developer magnetically borne on the developing roller 17.

Transfer sheets P, used as the recording media are stored in a cassette 20 positioned in a lower part of the copier body COPY. There will be provided plural cassettes 20 for different sheet sizes, which are easily interchanged according to the necessity. The transfer sheet P contained in said cassette 20 is maintained in contact, with a determined pressure, with a feed roller 20'. When the photosensitive drum 7 is rotated to a determined position, said feed roller 20' is rotated counterclockwise to advance the sheet P to the left. In this manner the transfer sheet P is guided, by paired rollers 21, 22, 23, from the cassette 20 to the photosensitive drum 7, and is brought into contact therewith in synchronization with the image thereon by paired rollers 24. Subsequently the transfer sheet P is charged by a transfer charger 30 receiving a positive high-voltage current from the high-voltage power source, thereby transferring said image from the drum 7 to said sheet P. The sheet P after said image transfer is subjected to a charge elimination by a separating charger 31 receiving an AC high-voltage current from the high-voltage power source, in order to reduce the adhesive force to the photosensitive drum 7. Then said sheet P is separated at a position 32 from the drum 7 and is guided to a fixing station 35 by means of a belt 34 driven by a roller 33. In said fixing station 35, the unfixed image on the transfer sheet P is fixed by a pressure applied by passing between paired rollers 36 mutually pressed at a determined pressure and rotated at a same peripheral speed. The sheet P coming out of the fixing station 35 is, after elimination of remaining charge by a charge eliminater 38, guided along guide members 39 to paired conveyor rollers 40.

The transfer sheet P guided by said paired rollers 40 is guided into a direction 42 or 43 by a switching lever 41, which is shifted according to the selection of determined copying modes as will be explained later. When said lever 41 is at the broken-lined position, the sheet P is advanced in a direction 42 and ejected, through an ejecting path 47 composed of paired rollers 44, 45, 46, to an ejecting slot 47'. On the other hand, when said lever 41 is at the solidlined position, the sheet P is guided into a direction 43 and advanced through a path 50 composed of paired rollers 48, 49 to an intermediate tray 51.

Said intermediate tray 51 is used, in the two-side copying mode, for temporarily storing the transfer sheets P having images on one side thereof. The sheets in said intermediate tray 51 are again supplied, in succession from the lower side thereof, to the photosensitive drum 7. The sheet P thus advanced is guided, by guide members 53, to a conveyor belt 55 driven by a roller 54, then to paired rollers 56 and other paired rollers 24. Said sheet P is then synchronized by said paired rollers 24 and brought into contact with the photosensitive drum 7 for receiving the transfer of the image in the same manner as in the case of sheet supplied from the cassette 20 explained before.

After said image transfer, the remaining developer on the photosensitive drum 7 is removed by an edge 61 of a blade cleaner 60, and said drum is thus used again for the succeeding imaging cycle. After the completion of imaging cycles of a preselected number, the photosensitive drum 7 is further rotated for removing the charge in the photosensitive layer by the charge elimination by the aforementioned AC charge eliminator 13 and by the uniform exposure to the light of the lamp 14, and is stopped after rotation of a determined amount as a preparation for the next operation.

In FIG. 1 there is also shown an automatic document feeder ADF provided on the copier body COPY and capable of automatic two-side copying. In said automatic document feeder ADF there are provided a tray 71 for inserting an original sheet for two-side copying, a tray 72 for inserting an original sheet for one-side copying, a tray 73 for temporarily stacking the original sheet in the two-side copying operation, and a tray 72 into which the original sheets are ejected after exposure. There are also provided an indicator lamp 75 provided in the vicinity of the tray 72, and another indicator lamp 76 provided in the vicinity of the tray 71. Said lamp 75 or 76 is lighted in response to the selection of the copying mode in the control panel to indicate a tray into which the operator should insert the original sheet as will be explained later. More specifically said lamp 76 or 75 is lighted respectively in the two-side copying mode or in the normal one-side copying mode.

In the normal one-side copying mode, upon insertion of an original sheet OS, with the image face to be copied upward, according to the instruction of the indicator lamp 75, an original sensor SS2 detects the inserted original sheet OS to enable the copying operation. Thereafter, in response to the actuation of the copy button, a separating-feeding roller 77 is rotated in a direction indicated by arrow, thereby advancing the original sheets OS in succession from the tray 72. The original sheet OS thus advanced is guided to a conveyor belt 83 through guide members 78, 79, 80 and switching levers 81, 82 which are at the solid-lined positions at the normal one-side copying mode.

Said belt 83 transports the original sheet OS to a determined exposure position on the supporting plate 1. Thereafter the copying cycle consisting of the original reading step, image transfer step etc., is repeated by a determined number of times to obtain copies of preselected number. Upon completion of the copying operation, the conveyor belt 83 is rotated counterclockwise to advance the original sheet OS toward the tray 74. A path switching lever 84 is at the solid-lined position in the one-side copying mode, whereby the original sheet OS is guided through an ejecting roller 85 to said tray 74. The above-described procedure is repeated until the original sheets OS on the tray 72 are exhausted.

In the two-side copying mode, the original sheet OS is inserted, with first face thereof upward, into the tray 71 according to the instruction of the lamp 76, whereby the original detecting sensor SS1 detects said original sheet to enable the copying operation. In a single copying mode in which the original sheet OS is copied only once, in response to the actuation of the copying button, a separating-feeding roller 86 is activated to feed the original sheets OS1 in succession from the upper one in said tray 71. In the two-side copying mode, the lever 84 is displaced to the broken-lined position to guide the original sheet OS1 to the conveyor belt 83 which is rotated clockwise, whereby said original sheet OS1 is brought to the exposure position on the plate 1 and stopped in said position. Thereafter the exposure step of the aforementioned copying cycle is initiated, and the image on a second (bottom) face of the original sheet OS1 is transferred on a first face P1 of the transfer sheet P supplied from the cassette 20. In the first copying cycle of the two-side copying mode the lever 41 is switched to the solid-lined position, whereby the transfer sheet P after first copying cycle is stored through a path 50 in the intermediate tray 51. Also, the original sheet OS1 after the exposure is advanced to the left by the conveyor belt 83. The switching levers 82, 81 are at the solid-lined positions whereby the original sheet OS1 is ejected through an ejecting roller 87 to the tray 72. Simultaneously with said ejection a second original sheet OS2 in the tray 71 is fed to the exposure position on the plate 1. In this manner the images on the second faces of the original sheets OS2–OSn stacked in the tray 71 are reproduced in succession on the first faces of the transfer sheets P2–Pn supplied from the cassette 20. Upon completion of copying on one side in this manner, the original sheets OS1–OSn are stacked in the tray 72 in this order from the bottom to the top, with the second faces which have been copied being directed upwards. Also, the transfer sheets P1–Pn are stacked in the intermediate tray 51 in this order from the bottom to the top, with the first faces thereof with reproduced images being directed upwards.

Now there will be explained the procedure of copying the images of the first faces of the original sheets onto the second faces of the transfer sheets. In this procedure the lever 81 is shifted to the broken-lined position and the separating-feeding roller 77 is activated to advance the original sheets OS1–OSn in the tray 72 in succession from the top, i.e., from the sheet OSn, to the temporary storage tray 73, whereby said original sheets OS1–OSn are stacked on said tray 73 in this order from the top to the bottom, with the second faces which have been copied being directed upwards. Then the lever 82 is shifted to the broken-lined position and the separating-feeding roller 88 is activated to advance the original sheet OS1 toward the plate 1. In this state the belt 83 is driven counterclockwise whereby the original sheet OS1 is brought to the exposure position and stopped at said position. Then a re-feeding roller 52 is activated to again advance the transfer sheets P stored in the intermediate tray 51. As explained before the transfer sheets P1–Pn are stacked in said tray 51 in this order from the bottom to the top, so that they are supplied from the sheet P1 by the rotation of said roller 52. The copying cycle is initiated with suitable synchronization, thus reproducing the image on the first face of the original sheet OS1 onto the second face of the transfer sheet P1. After the copying cycle the transfer sheet P1 is guided through the lever 41 at the broken-lined position and through the ejecting path 47 and ejected from the copier body COPY. The original sheet OS1 after the exposure is ejected, through the lever 84 at the solid-lined position, to the tray 74. The above-described procedure is repeated for the succeeding original sheets OS2–OSn to reproduce the images on the first faces thereof onto the second faces of the transfer sheets OP2–OPn.

Now there will be explained a procedure of making plural copies with a two-side copying mode for each sheet original.

In this case an original sheet inserted into the tray 71 is transferred to the determined position on the original supporting plate 1 in the same manner as explained in the foregoing, and the image on the second (bottom) face of the first original sheet is copied for a desired number of times.

After such copying cycles the original sheet is transferred, through the tray 72, to the tray 73 as explained in the foregoing.

Also the transfer sheets P used in these copying cycles are stored in the intermediate tray 51.

Then said original sheet is fed from the tray 73 to the determined exposure position on the plate 1 for copying the opposite face, and the transfer sheets P are supplied from the intermediate tray 51. After copying cycles of a determined number, the transfer sheets P are ejected from the copier body while the original sheet is ejected to the tray 74.

Upon completion of the above-described procedure a second original sheet stacked on the tray 71 is supplied to the original supporting plate 1 and the above-described procedure is repeated. The procedure is repeated until the original sheets on the tray 71 are exhausted.

In FIG. 1 there are provided sensors SS1, SS2, SS3, SS4 respectively for detecting the original documents in the trays 71, 72, 73 and intermediate tray 51.

A sorter SORT connected to the copier body COPY accepts, in the sorter mode, the transfer sheets P ejected from the slot 47', through an entrance slot 90. In said sorter there is provided a transfer sheet storage unit 91 comprising plural storage bins **91-*l* - 91-*m*, in which the transfer sheets P supplied from the copier body COPY are stored with the imaged faces downwards. There is also provided another tray 92 for accepting, in the sampling mode for inspecting the density, position etc., of the transferred image, the transfer sheet supplied from the copier body COPY. Said tray 92** is provided with a sensor SS5 for detecting the transfer sheet therein.

Figure 2:
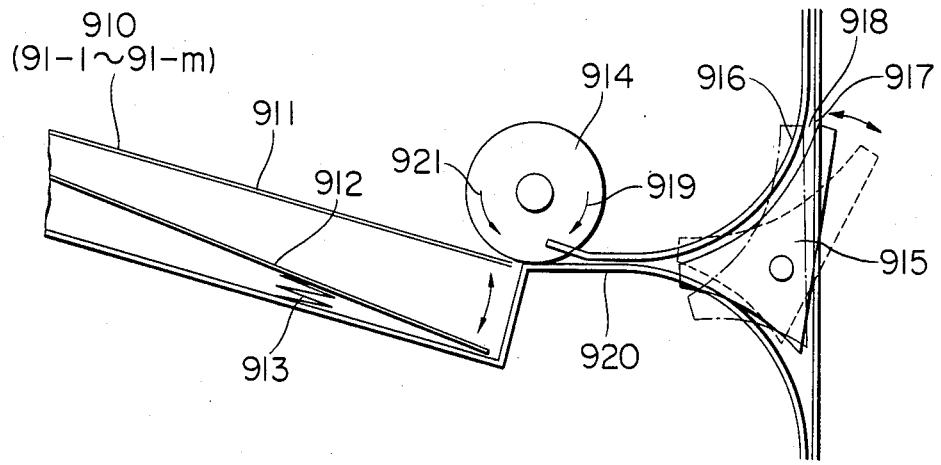
FIG. 2 is a partial magnified view of a storage bin of the sorter shown in FIG. 1.

FIG. 2 shows the details of the storage bins **91-*l* - 91-*m*. In each storage bin, represented by a number 911, there is provided a plate member 911 which is rendered rotatable to a position 912 about an unrepresented axis. Said plate member 911 is biased upwards by a spring 913 in such a manner as to obtain a suitable contact pressure between the transfer sheet on said plate member 911 and a feeding roller 914 in case said transfer sheet is to be ejected from the bin 910. A switching guide member 915, when at the solid-lined position, deflects the transfer sheet travelling along a path 918 composed of guide members 916, 917 into the storage bin 910. In such storing operation, the plate member 911 is pressed down to the position 912 against the force of the spring by means for example of an unrepresented solenoid, and the roller 914 is rotated in a direction indicated by arrow 919, thereby introducing the transfer sheet into the bin 910. Said roller 914 is maintained in contact with a lower guide 920, thereby securely pinching the transfer sheet and ensuring the storage thereof. In case of ejecting the transfer sheet from the bin 910, said unrepresented solenoid is deactivated to eliminate the biasing force to the plate member 911, whereby the plate member 911 is pushed upwards by the spring 913 to bring the transfer sheet into contact with the roller 914. In this state the roller 914 is intermittently rotated in a direction 921 by a clutch to advance the transfer sheets one by one. In this state the switching guide member 915** is so positioned as to direct the transfer sheets to the sheet transport path.

Figure 3:
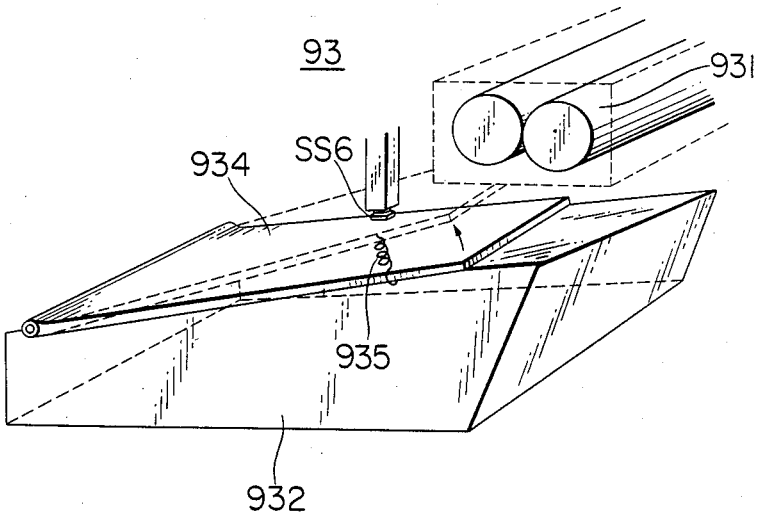
FIG. 3 is a partial magnified view of a shredding unit shown in FIG. 1.

Again referring to FIG. 1, the sorter SORT is provided in a lower part thereof with a sheet shredding unit 93 comprising, as shown in FIG. 3, a shredder 931, a container 932 for storing the shredded sheets and a sensor SS6 for detecting that the container 932 is filled with the shredded sheets. Said container is provided with a lid 932, which is closed with a weak spring 935. When the lid 934 is lifted to a position 36 by the shredded sheets in the container 932, the sensor SS6 is pushed by the lid 934, thus detecting the full state of the container 932. Said sensor 932 can be composed of a microswitch or a pressure sensor.

The above-described sorter SORT functions in the following manner. The transfer sheet P transported into the sorter SORT through the slot 90 is moved to the right by paired transport rollers 94. The switching lever 95 is shifted, at the sampling mode, to the solidlined position to store the transfer sheet P into the separate tray 92. Consequently the transfer sheet P is guided along a path 98 provided in succession with paired rollers 96 and paired ejecting rollers 97 and is stored in the tray 92. The operator judges whether the image on the transfer sheet P is abnormal or not and accordingly decides the process thereafter. In case the transfer sheets P are to be transported to the storage unit 91, the lever 95 is shifted to the broken-lined position thereby guiding said sheets to a path 101 provided with paired rollers 99, 100. Thereafter the sheets are guided to the path 918 through rollers 102, 103 and stored in the determined storage bins. The tray 92 is connected with the path 918 as illustrated. When the operator judges the image on the sampled transfer sheet P as abnormal and presses a recovery button to be explained later, the transfer sheets P in the tray 92 and in the storage bins are transported by paired rollers 105 and rollers 104 to the transport path 918 and are shredded in the shredding unit 93.

A sheet detecting sensor SS7 is positioned close to the entrance of said shredding unit 93, and the number of the transfer sheets P to be shredded is counted by the output signals of said sheet sensor SS7.

Figure 4:
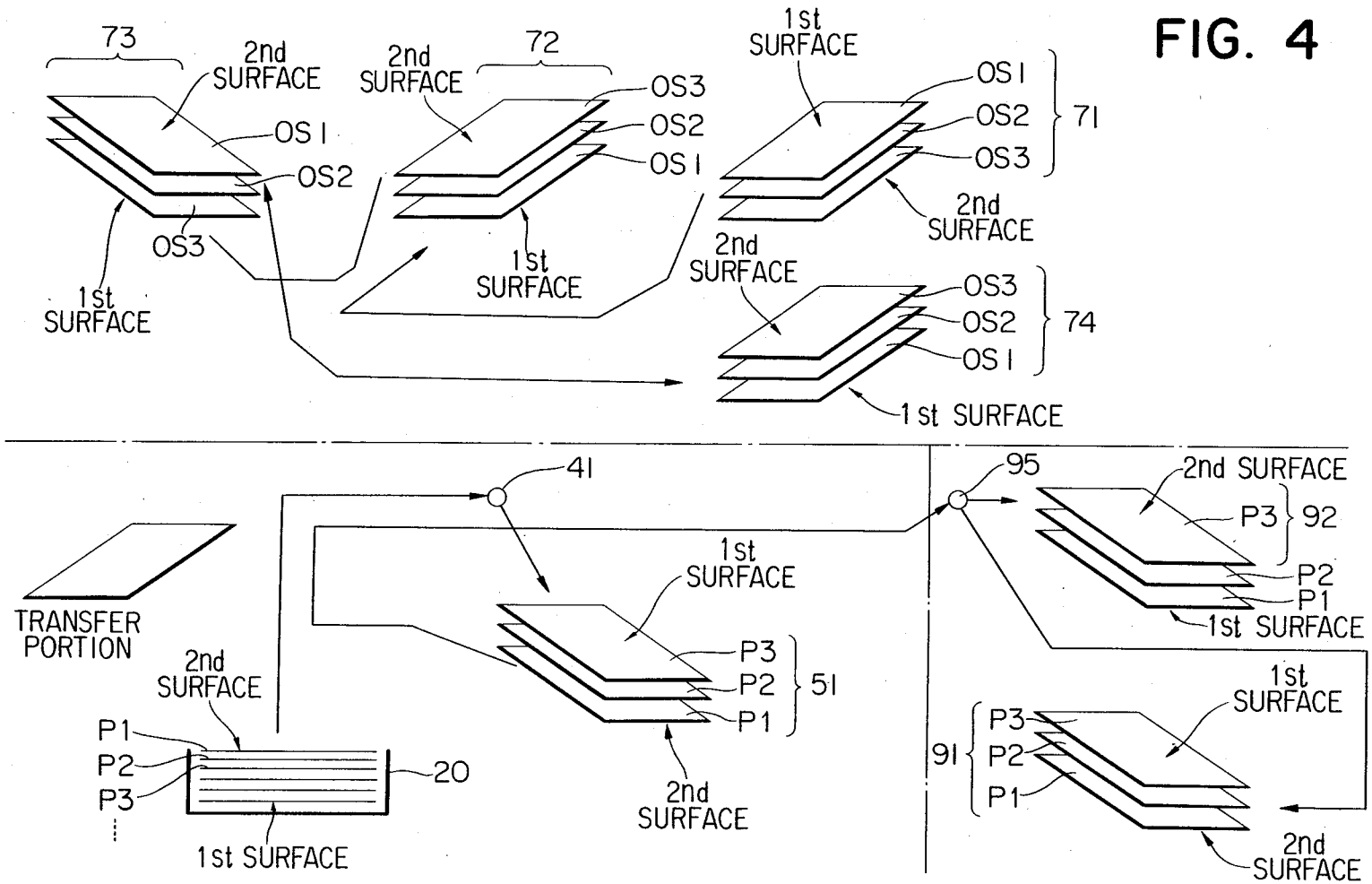
FIG. 4 is a chart showing the state of transportation of sheet originals and transfer sheets in a two-side copying mode with the automatic feeder shown in FIG. 1.

FIG. 4 shows the movements of the original sheets and the transfer sheets in the two-side copying mode with the automatic feeder in the present embodiment.

Figure 5:
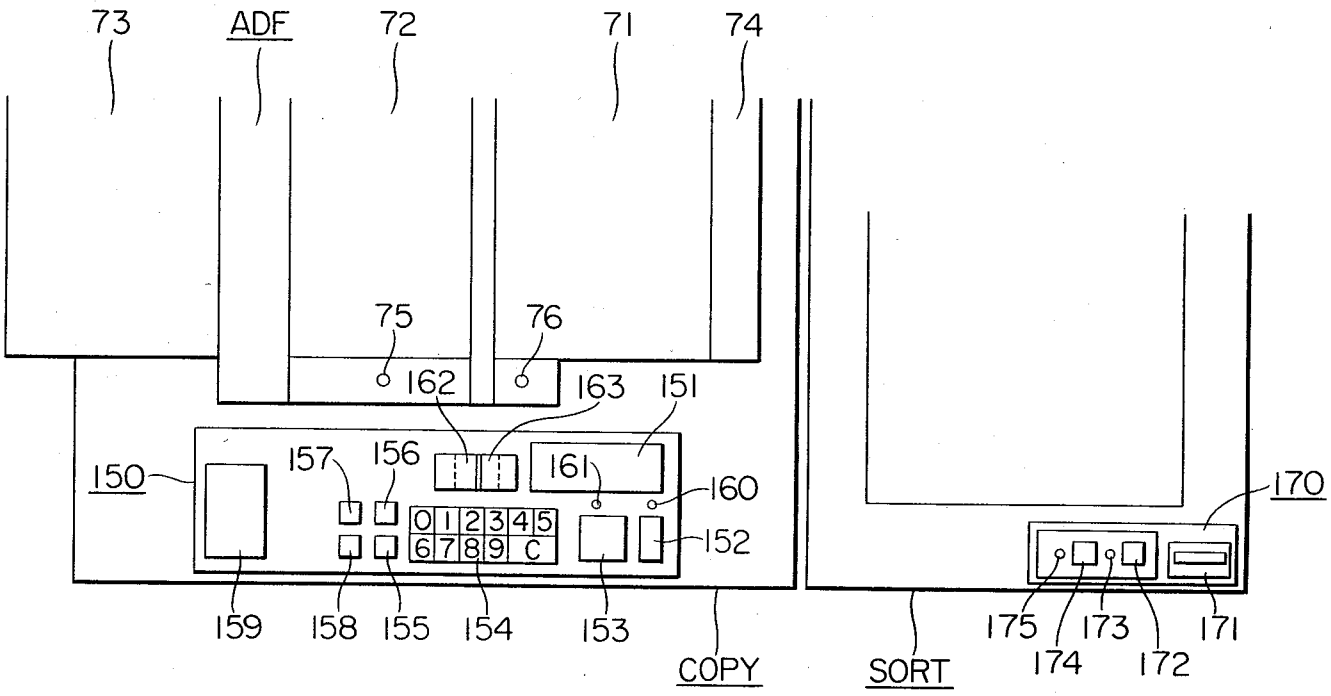
FIG. 5 is a schematic view of a control panel of the apparatus shown in FIG. 1.

FIG. 5 shows an example of the control panel for use in the apparatus of the present invention, wherein a control unit 150 for the copier body COPY is provided with an alarm indicator unit 151 for indicating the absence of transfer sheets, absence of toner, sheet jamming etc.; a recovery button 152; a copy button 153; numeral keys 154 for entering the number of copies to be made; a sorter selecting button 155; an automatic document feeder selecting button 156; a two-side mode button 157; a sampling button 158; a size indicator 159 for the sheet contained in the cassette 20; a recovery operation indicating lamp 160; a waiting indicator lamp 161; an indicator 162 for the set copy number to be set by the numeral keys 154; and a copy number indicator 163. There are also provided a lamp 75 for instructing the insertion of one-side original sheets into the tray 72 in the normal copying mode with the automatic document feeder, and a lamp 76 for instructing the insertion of two-side original sheets into the tray 71 in the two-side copying mode with the automatic document feeder. A control unit 170 for the sorter SORT comprises a counter 171, a shredder operating button 172, a shredding indicator lamp 173, an editing button 174 and an editing operation indicator lamp 175.

Figure 6:
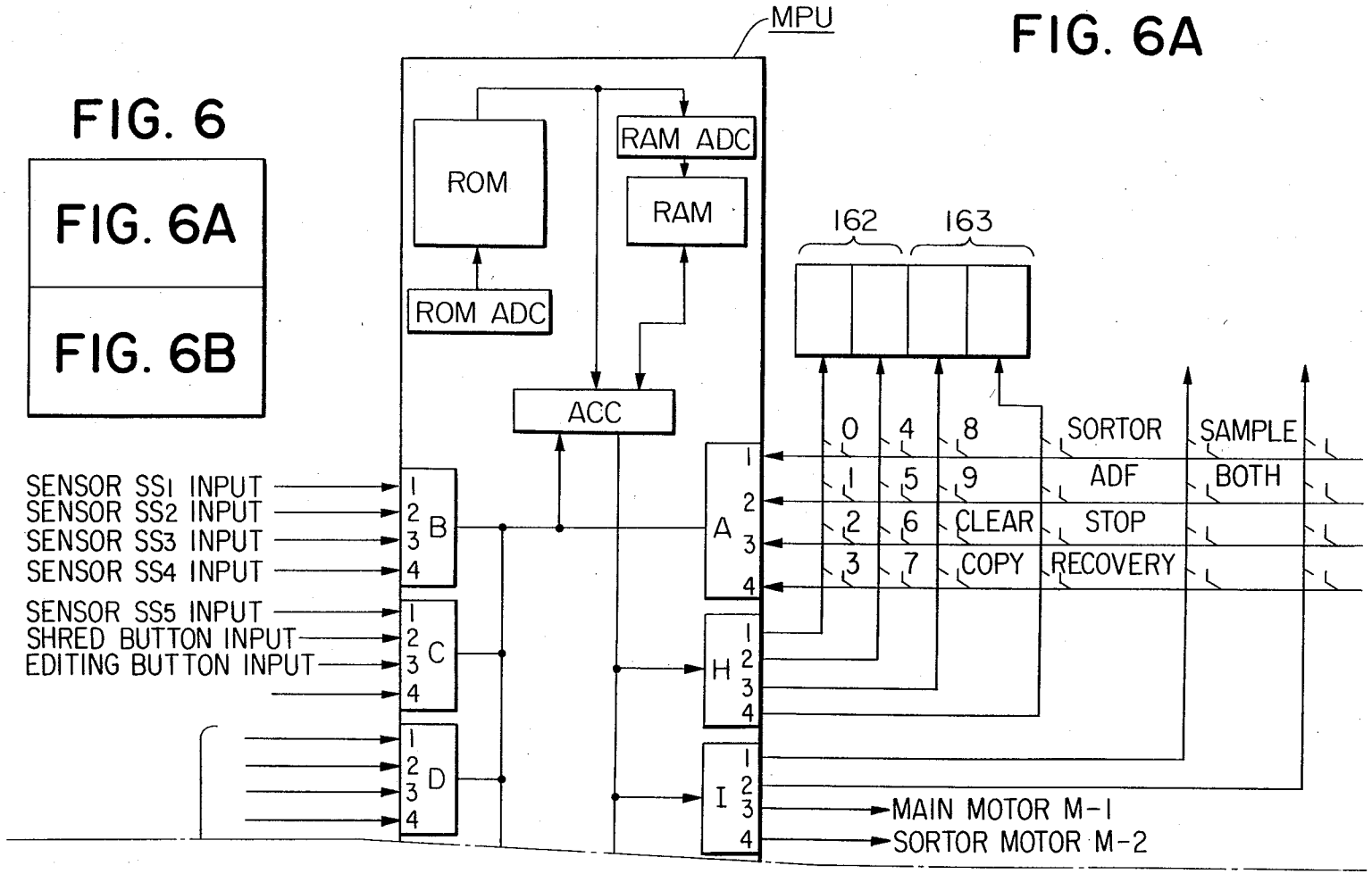
FIG. 6 composed of FIGS. 6A and 6B is a block diagram showing a control system of the apparatus shown in FIG. 1.

The control unit for controlling the functions of the apparatus of the present invention is composed of a microcomputer MPU, which, as shown in FIG. 6, is provided with a read-only memory ROM, a random access memory RAM and a processing accumulator ACC, and has 4-bit input ports A–G and output ports H–M, 0, P for releasing various control output signals. An interruption port INT receives drum clock pulses generated according to the rotation of the photosensitive drum 7, and the various functions of the copier COPY are controlled in response to said drum clock pulses.

Figure 7:
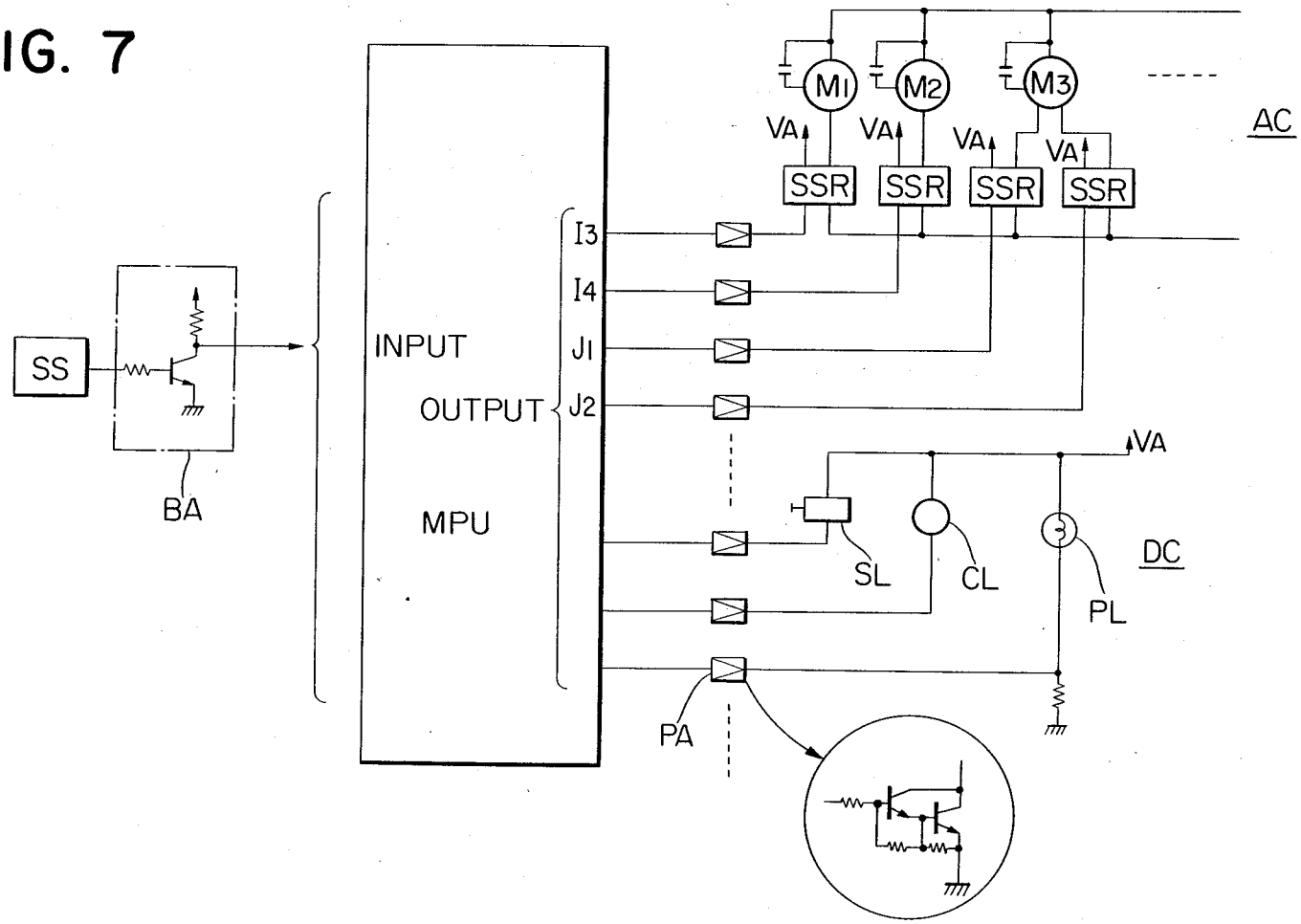
FIG. 7 is a block diagram showing sensors and loads respectively connected to input and output ports of said control system.

The input ports of said microcomputer MPU are connected, as shown in FIG. 7, with sensors SS through transistorized buffer amplifiers BA, while the output ports are connected through transistorized Darlington power amplifiers PA to various DC loads such as solenoids SL, clutches CL, lamps PL etc., and also constitute driving circuits for driving a main motor M1, a sorter motor M2, an automatic document feeder motor M3 etc., through solid-state relays SSR.

Now the functions of the apparatus of the present invention will be explained in detail by the flow charts shown in FIGS. 8 to 14. At first referring to FIG. 1, a step S1 is executed after the start of power supply to clear the random access memory RAM, and a step S2 is then executed to set the copying conditions by the key entries from the control unit 150 and to display the set copy number and the alarms. A succeeding step S3 discriminates whether the sorter selecting button 155 has been actuated, and, if so, a step S4 is executed to set a flag F/SORTER, or, if not, a step S5 is executed to reset the flag F/SORTER. A step S6 discriminates whether the automatic document feeder selecting button 156 has been actuated, and, if so, a step S7 is executed to set a flag F/ADF, or, if not, a step S8 is executed to reset the flag F/ADF. A step S9 discriminates whether the sampling button 152 has been actuated, and, if so, a step S10 is executed to set a flag F/SAMPLE, or if not, a step S11 is executed to reset the flag F/SAMPLE. Then a step S12 discriminates whether the both-side mode button 157 has been actuated, and, if so, a step S13 is executed to set a flag F/BOTH-SIDE, or, if not, a step S14 is executed to reset the flag F/BOTH-SIDE.

Then a step S15 discriminates, through the input port C2, whether the shredder button 172 in the control unit 170 of the sorter SORT has been actuated. In the present embodiment the sorter SORT is provided with a shredder unit 93, which can also be used as an ordinary shredder by said shredder button 172 when the copying operation is not in progress. If the actuation of the shredder button 172 is identified in the step S15, the program proceeds to a step S18. Said step S18 discriminates, by the aforementioned sensor SS6, whether the container 932 is full, and, if not, a step S19 is executed to set the output port I4 of the microcomputer MPU in order to activate the sorter motor M2 and to set the output port L2 in order to drive the roller 105 for sheet feeding from the tray 92. The above-described process in the step S19 will hereinafter be called SUB.B. A succeeding step S20 sets the output port L3 to drive the shredder unit 931, and simultaneously lights the lamp 173 indicating the active state of said shredder unit. The program returns from the step S20 to the step S15 and continues the above-explained loop (S15, S18–S20) until the shredder button 172 is turned off. If the step S18 identifies a full container state, the program proceeds to a step S21 for flashing the lamp 173.

In case the step S15 discriminates the turned-off state of the shredder button 172, a step S16 is executed to reset the output port I4 thereby deactivating the sorter motor M2 and to reset the output port L2 thereby stopping the roller 105. The process in said step S16 will be called SUB.B. Then a step S17 is executed to reset the output port L3 thereby deactivating the shredding unit 931 and to extinguish the lamp 173. Then a step S22 discriminates, by the input port C2, whether the editing button 174 has been actuated. The sorter SORT of the present embodiment has a simple editing function of correcting inverted order of pages of the original sheets. In this mode, in response to the actuation of the editing button 174 after the original sheets to be edited are placed on the tray 92, the program proceeds to a step S24 to execute the process SUB.B for activating the sorter motor M2 and driving the roller 105. The original sheets on the tray 92 are fed in succession from the upper side to the storage bins 91. Then a step S25 stores the sheets into determined storage bins. Then a step S27 lights the editing lamp 175, and a loop of the steps S24, S25, S26 and S27 is continued until the step S25 discriminates the absence of sheet in the tray 92 by the sensor SS5. When the step S26 discriminates that all the sheets in the tray 92 have been stored in the sorter bins 91, a step S28 is executed to extinguish the lamp 175, and the step S23 executes the process SUB.A for deactivating the sorter motor M2 and stopping the roller 105. In the above-described process the original sheets etc. are transported to predetermined empty bins. It is also possible to adopt an arrangement in which such empty bins can be arbitrarily selected for example by numeral keys, and such arbitrary bin selection enables an insertion of additional pages afterwards.

Then a step S29 discriminates whether the apparatus is in the waiting mode because of a deficient heater temperature, lack of transfer sheets or of toner, and, if not, a step S30 discriminates whether the copy button 153 has been actuated. If not, the program returns to the step S2 and the above-described procedure is repeated. On the other hand, in case the step S30 identifies the actuation of the copy button 153, the program proceeds to a step S31. The above-described steps S1–S30 constitute a copying stand-by cycle.

Figures 9, 9C:
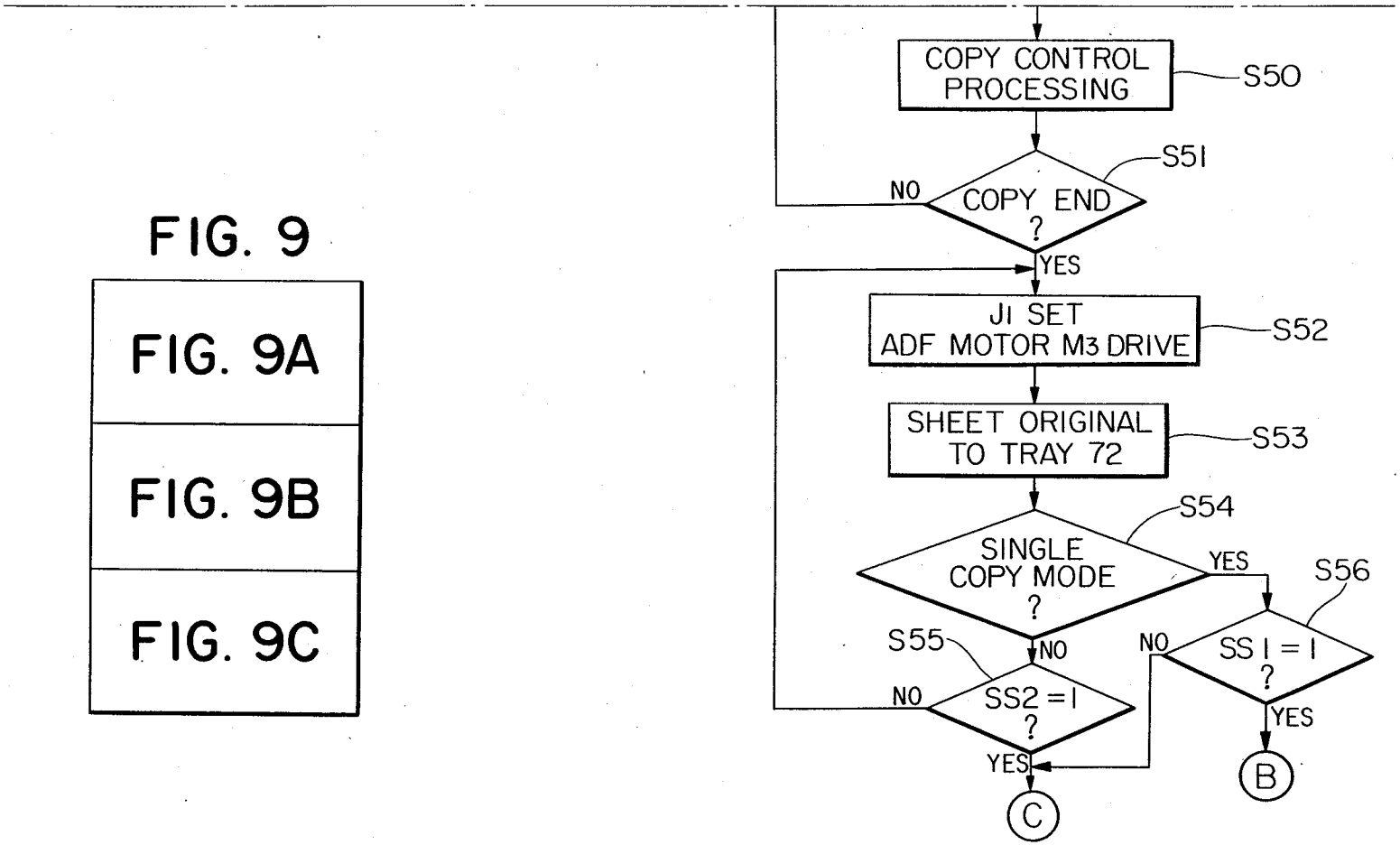
Figure 9A:
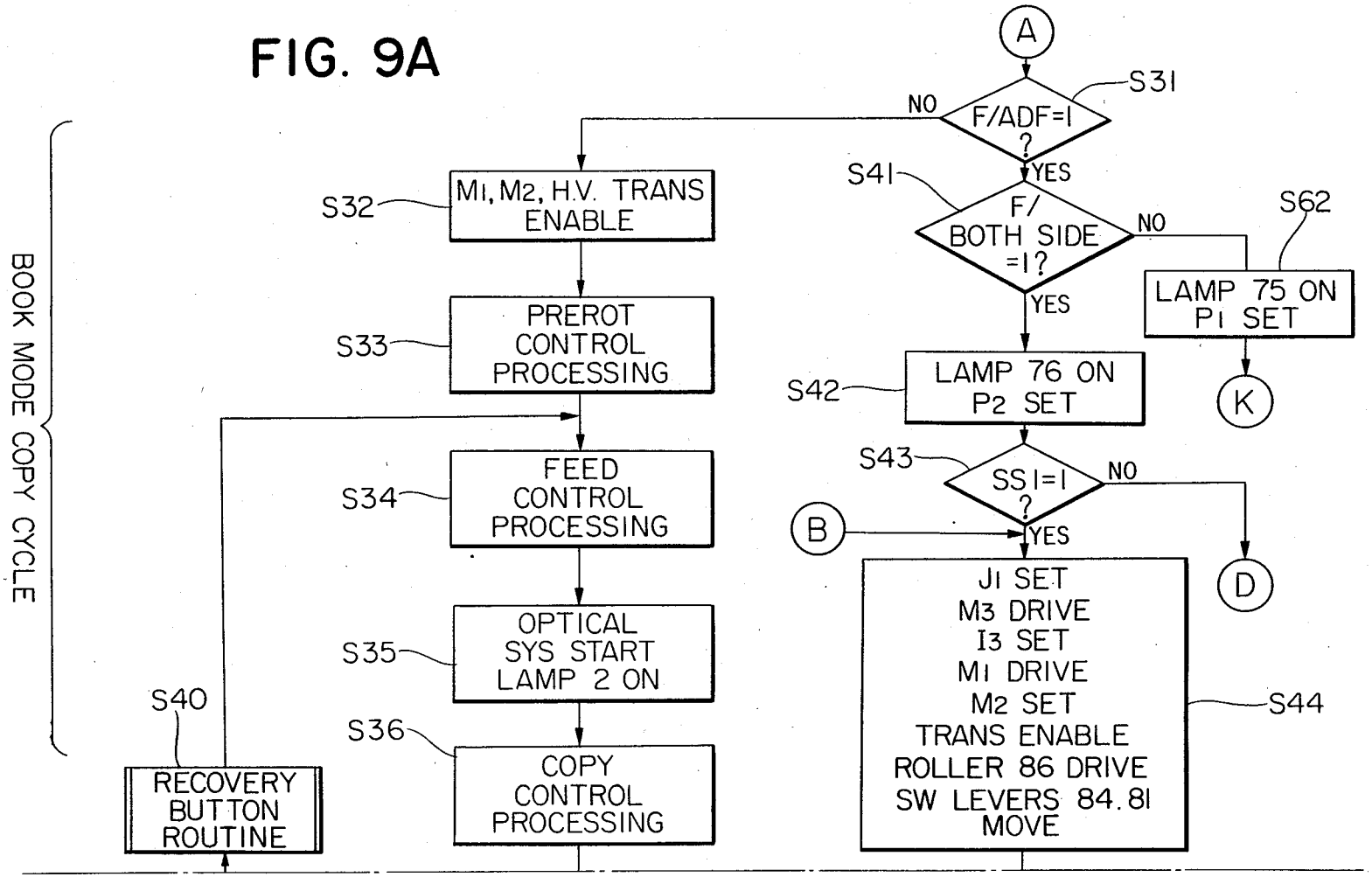

In the following explained is the copying cycle. Referring to FIG. 9, a step S31 discriminates the flag F/ADF, indicating whether the feeder selecting button 156 has been actuated in the copying stand-by cycle. In the following there will be given an explanation on a book copying mode in which the automatic document feeder is not selected. The automatic document feeder in this embodiment, positioned on the copier body COPY as shown in FIG. 1, can be lifted about an unrepresented shaft positioned behind the plane of FIG. 1 and can be locked in such lifted position in case of copying bound originals such as a book. In such case the program proceeds from the step S31 along the "NO" branch to a step S32 for activating the main motor M1, sorter motor and a high-voltage transformer for the chargers. Then a step S33 executes a pre-rotation step in which the drum is rotated one or two turns in order to achieve a uniform potential on said drum 7. Upon completion of said pre-rotation step, a step S33 executes sheet feeding control by driving the feed roller 20' in order to advance the transfer sheet from the cassette 20. A succeeding step S35 generates an optical system start signal for moving the optical system to the right at a determined timing for exposing the book original. Then the illuminating lamp 2 is lighted and the program proceeds to a step S36 for executing the determined copying control.

Then a step S37 discriminates whether the apparatus is in a stop mode, and, if not, a step S38 is executed to compare the number of completed copies with the set copy number. If said numbers do not coincide, a step S39 executes a sorter control routine to be explained later, and a step S40 executes a recovery button routine to be explained later. Thereafter the copying cycle is executed by the steps S34, S35, S36, S37 and S38. Upon completion of the copies of a determined number in this manner, the program proceeds from the step S38 to a step S79.

Figures 12, 12B:
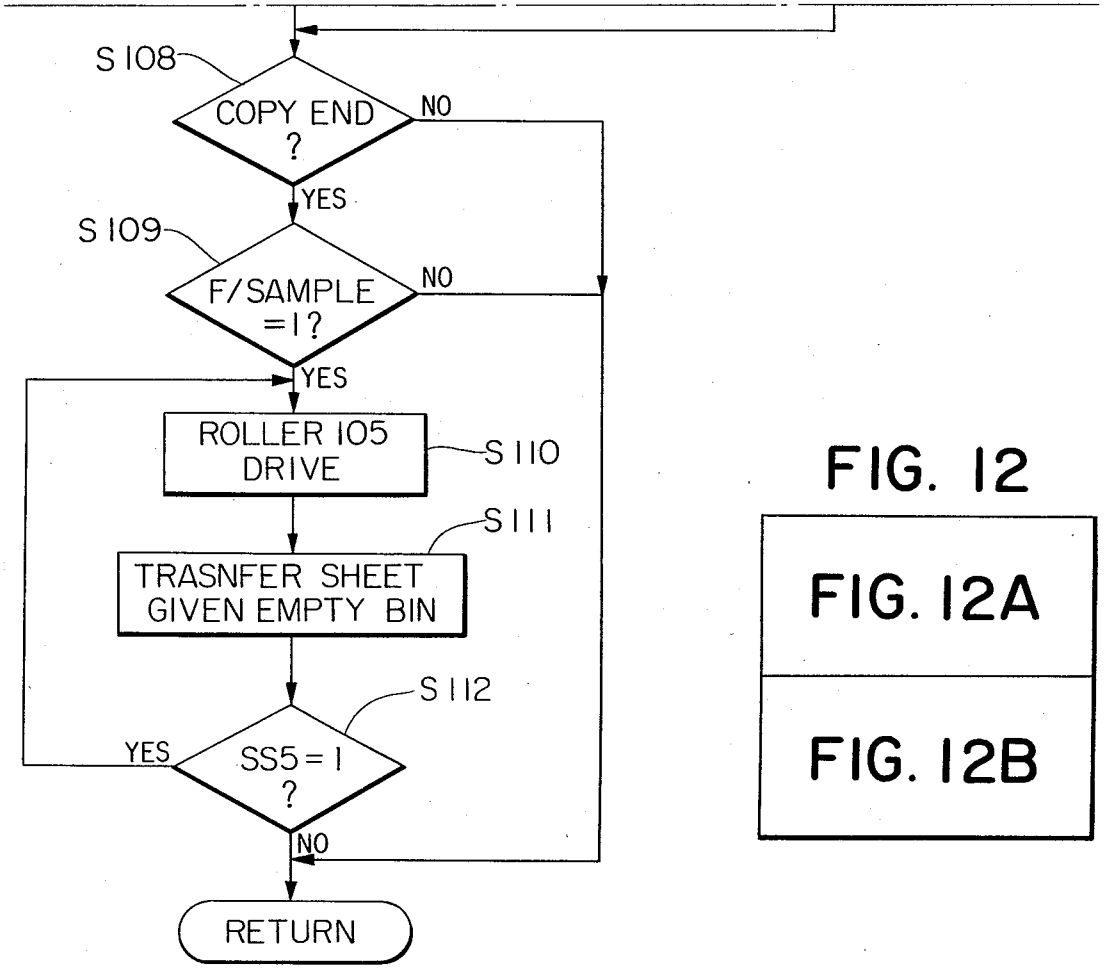

Now reference is made to the sorter control routine shown in FIG. 12. At first a step S100 discriminates, by the flag F/SORTER, whether the sorter selecting button 156 has been actuated, and, if not, a step S106 is executed to set the output port L1 thereby shifting the switching lever 95 to the solidlined position in FIG. 1 for storing the transfer sheets from the copier body COPY into the separate tray 92. Then a step S107 executes a storage process for storing the sheets into the tray 92, and the program proceeds to a step S108. On the other hand, in case the sorter selecting button 156 has been actuated, the program proceeds from the step S100 to a step S101 for discriminating, by the flag F/SAMPLE, whether the sampling button 158 has been actuated. If said flag is set, a step S102 discriminates whether the transfer sheet which has completed the copying cycle is the first sheet. If so, a step S103 is executed to shift the switching lever to the solid-lined position as in the aforementioned step S106 thereby advancing the sheet to the tray 92 with the image face upwards, in order to facilitate the confirmation of the copied image by the operator. Then a step S104 shifts the switching lever 95 to the broken-lined position shown in FIG. 1, thereby advancing the second and succeeding sheets to the storage bins 91, and a step S105 stores said sheets into the bins 91-*l* - 91-*m*. Then a step S108 discriminates whether the copying process in the copier COPY has been completed, and, if not, the program proceeds to a step S40 shown in FIG. 9. If the copying process has been completed, a step S109 discriminates the flag F/SAMPLE, and, if it is set, the aforementioned editing process is executed. In this state the sampled transfer sheets are transported to the tray 92 with the image faces thereof upwards from the first page, and are stacked in said tray 92 with inverted order of pages. After the completion of copying process, said transfer sheets stacked in the inverted order are released in succession from the first page at the bottom by the roller 105, and are stored in the determined empty bin 91. In this manner said transfer sheets are stacked in the normal order from the first sheets, with the image faces downwards, in said empty bin. Such editing process is conducted by the steps S110–S112. Upon detection of the absence of the transfer sheets in the tray 92 in the step S112, the program proceeds to a step S40 shown in FIG. 9.

Figure 13:
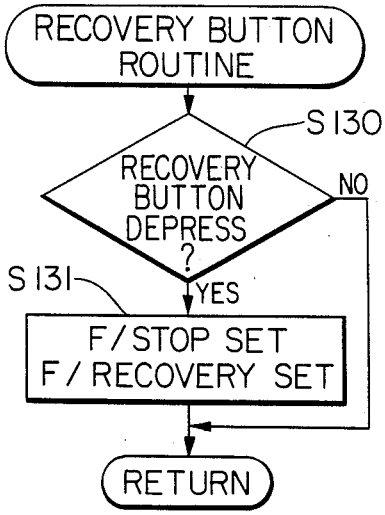

The recovery button routine in said stap S40 is shown in FIG. 13. At first a step S130 discriminates whether the recovery button 152 has been actuated, and, if so, a step S131 is executed to set a flag F/RECOVERY and to set a flag F/STOP for instructing the stop mode. Then the program returns to the step S34 shown in FIG. 9.

Figures 11, 11B:
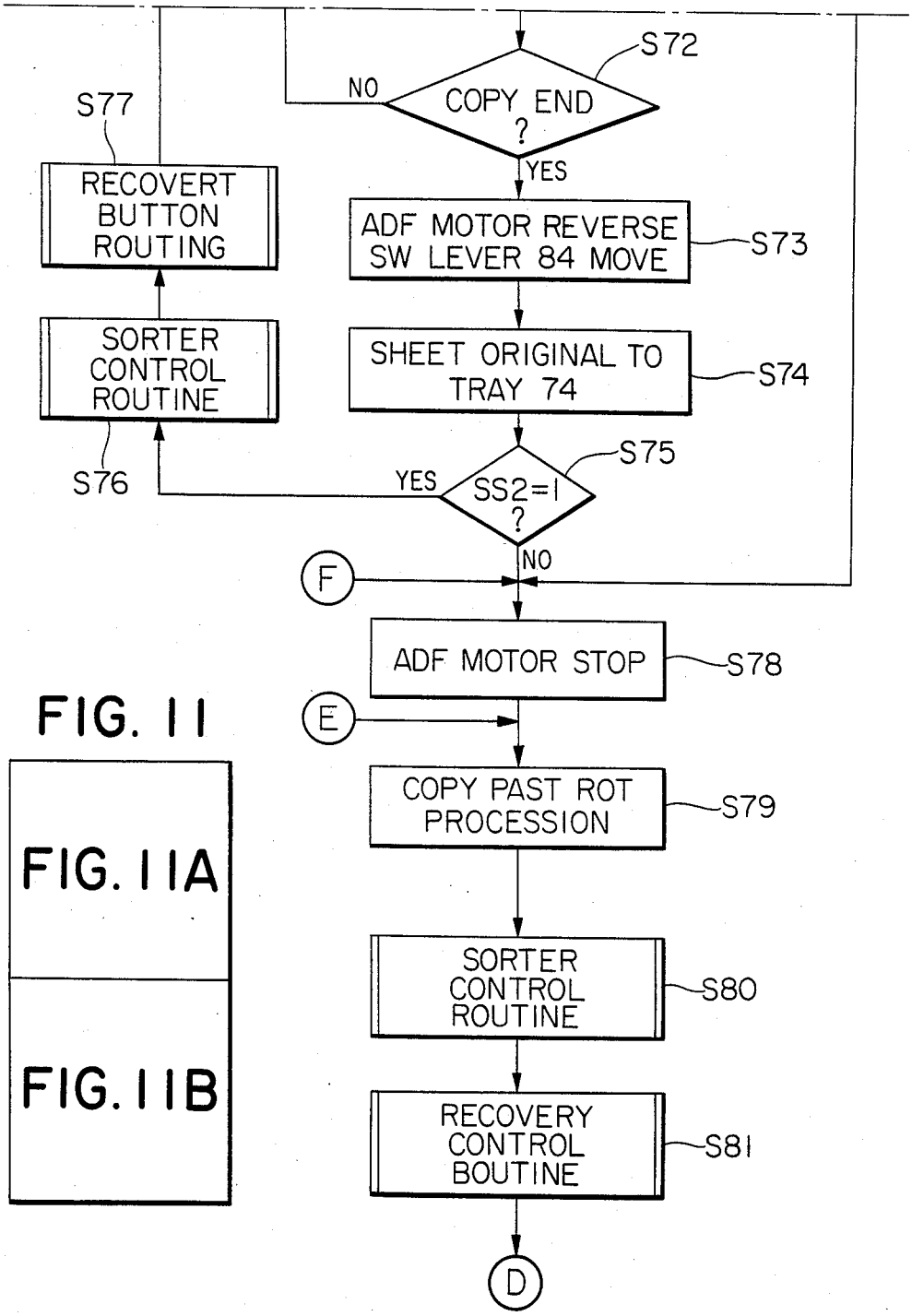
Figure 11A:
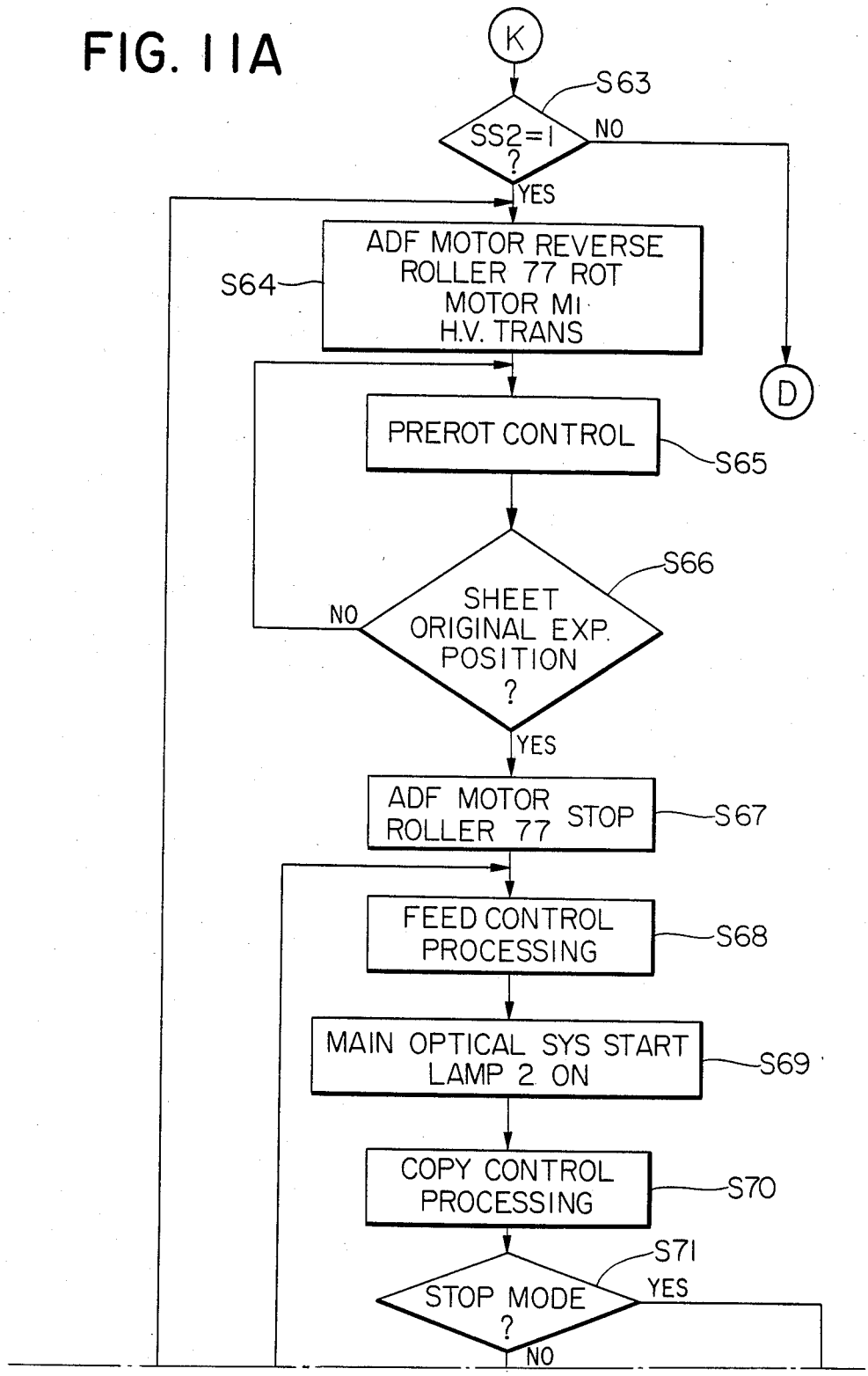

In case the operator identifies an abnormal image on the transfer sheet ejected to the tray 92 of the sorter in the sampling copy mode and actuates the recovery button 152, the program proceeds from the step S37 along the "YES" branch to a step S79 in FIG. 11 for electrostatically cleaning the photosensitive drum 7 by the post-rotation step and thereafter terminating the copying operation. A succeeding step S80 executes a storing operation for storing the second and succeeding transfer sheets supplied from the cassette 20 before the actuation of the recovery button 152 into the storage bins 91, and a step S81 executes a recovery control shown detailedly in FIG. 14.

Figure 14:
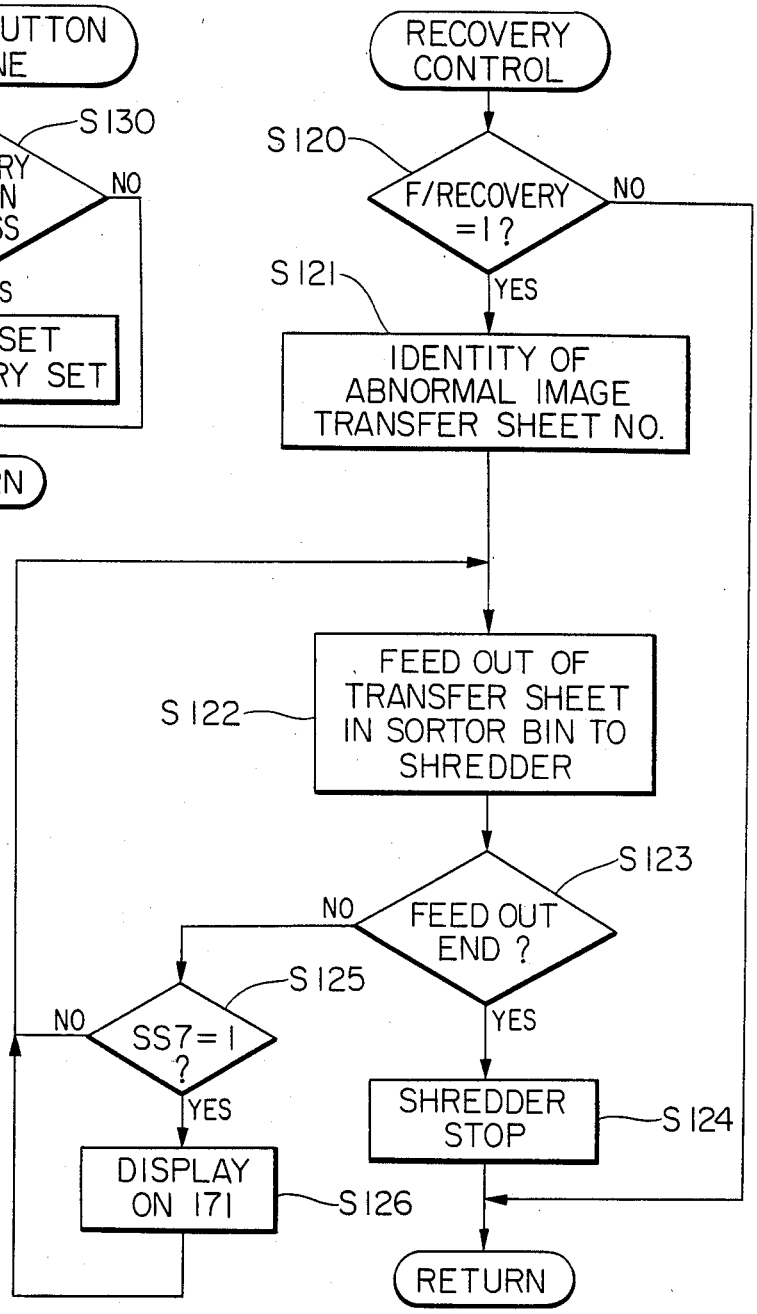

Referring to FIG. 14, a step S120 discriminates the flag F/RECOVERY to be set by the recovery button, and, if it is set, a step S121 is executed to confirm the number of transfer sheets bearing abnormal images in the already conducted copying cycles. Then a step S122 sets the output port L3 to activate the shredding unit 931 in the sorter, selects the storage bins according to the number of transfer sheets confirmed in the step S121, and activates the rollers 914 in the opposite direction (as indicated by arrow 921 in FIG. 2.) for ejecting the transfer sheets with abnormal images from the bins 91 to the shredder unit 93. The above-described procedure is repeated until a step S123 identifies that the transfer sheets bearing abnormal images are exhausted. A step S125 detects the transfer sheets bearing abnormal images by the sensor SS7 in the course of transportation to the shredding unit 93, and a step S126 counts, by the detection signals, the number of such transfer sheets transported to the shredder unit 93, and displays said count on the count indicator 171 of the control unit 170. When the ejection process is completed, as indicated by the coincidence of the count with the number of transfer sheets with abnormal images, the program proceeds to a step S124 for deactivating the shredder unit 931.

Now there will be given an explanation on the function of the automatic document feeder mode. In said mode the program proceeds from the step S31 shown in FIG. 9 along the "YES" branch to a step S41. Said step S41 discriminates the state of the flag F/BOTH-SIDE indicating the actuation of the both-side button 157, and, if said flag is set, a step S42 lights the lamp 76 to instruct the insertion of the original documents into the tray 71. Then, upon detection of the insertion of the originals, in a step S43, by the sensor SS1 provided in the lower part of the tray 71, a step S44 is executed to activate the main motor M1, high-voltage transformer, automatic feeder motor M3 and separating-feeding roller 86, to shift the switching lever 84 to the broken-lined position in FIG. 1 and to shift the switching lever 41 to the solid-lined position in FIG. 1 thereby transporting the transfer sheets to the intermediate tray 51. Then a step S45 executes the pre-rotation process in the same manner as in the step S33, a step S46 discriminates whether an original sheet has been fed from the tray 71 and set in the exposure position of the plate 1, and, if so, a step S47 is executed to deactivate the feeder motor M3 and the roller 86. The setting of the original sheet at said exposure position is identified by the lapse of a determined time from the detection of the leading end of said original sheet by a sensor positioned in the feed path.

A step S48 executes a process for feeding the transfer sheet from the cassette 20, then a step S49 starts the movement of the optical system (lamp 2, mirrors 3, 4) at a determined timing and lights said lamp 2, and a step S50 performs the copying control step. Then a step S51 discriminates whether the copying of a predetermined number has been completed, and, if not, the program returns to the step S48 for continuing the copying operation. If the copying operation has been completed, a step S52 is executed to activate the automatic feeder motor M3 thereby ejecting the original sheet of which the first face has been exposed to the tray 72. In this state the transfer sheet, having received the image transfer on the first face thereof, is stored in the intermediate tray 51 as explained before. A step S54 discriminates, by the set copy number, whether the single copy mode or multiple copy mode has been selected. In case of the single copy mode in which only one copy is desired for the both-side original sheet, the program proceeds through a step S56 to the step S44 to repeat the above-described procedure. On the other hand, in the multiple copy mode in which plural copies are required for each both-side original sheet, a step S55 discriminates whether the original sheet has been transported to the tray, and, if so, the program proceeds to a step S57 shown in FIG. 10. The step S57 activates the automatic feeder motor M3 and roller 77 for transporting the original sheet from the tray 72 to the tray 73 and shifts the switching lever 81 to the broken-lined position shown in FIG. 1. Then steps S58, S59 transport all the original sheets (all the original sheets in case of the single copying mode or one original sheet in case of the multiple copying mode) from the tray 72 to the tray 73. A succeeding step S60 stops the roller 77, and a step S61 discriminates, by the sensor SS3, whether the original sheets have been transported to the tray 73. If affirmative, a step S82 sets the switching lever 82 to the broken-lined position shown in FIG. 1 and feeds the original sheets on the tray 73 to the plate 1 by the separating-feeding roller 88. A step S83 discriminates whether the original sheet has been transported to the exposure position on the plate 1, and, if so, a step S84 stops the automatic feeder motor M3 and roller 88 and a step S85 activates the roller 52 to advance the transfer sheets in the intermediate tray 51 to the image transfer station for image formation on the second faces of said sheets. Then a step S86 starts the optical system at a determined timing and lights the lamp 2, and a step S87 is executed to expose the first face of the original and to form an image on the second face of the advanced transfer sheet. Then a step S88 discriminates whether the stop mode is instructed, and, if not, a step S89 discriminates whether the copying cycles of a determined number have been completed. If not, the program proceeds through the sorter control routine in the step S90 and the recovery button routine in the step S91 to the step S85, thus continuing the copying operation. Upon completion of the copying cycles of the set number, the program proceeds from the step S89 to a step S92, thereby shifting the switching lever 84 to the solid-lined position in FIG. 1 and driving the automatic feeder motor M3 to eject the original sheet to the tray 74 in a step S93. A step S94 identifies whether the single copying mode or the multiple copying mode has been selected, and, if the latter is selected, the program proceeds through a step S96 to the step S44 shown in FIG. 9. In case the single copying mode is selected, the program proceeds to a step S95 and the steps S82–S95 are repeated until all the original sheets on the tray 73 are exhausted.

Finally there will be explained the normal copying mode with the automatic document feeder. In said mode, the program proceeds from the step S41 shown in FIG. 9 along the "NO" branch to a step S62 for lighting the lamp 75 for instructing the insertion of the original sheets into the tray 72. A step S63 discriminates whether the original sheets have been inserted, and, if so, a step S64 activates the main motor M1, high-voltage transformer, automatic feeder motor M3 and separating-feeding roller 77 to advance the original sheet from the tray 72 to the plate 1. Then a step S65 effects the pre-rotation step of the copier COPY, and a step S66 discriminates whether the original sheet has been transported to the exposure position. If it has been transported, a step S67 stops the automatic feeder motor M3 and roller 77, and a step S68 is executed to feed the transfer sheet from the cassette 20. A step S69 then starts the optical system at a determined timing and light the lamp 2, and a step S70 executes the copying control step. Subsequently a step S71 discriminates whether the stop mode has been instructed, and a step S72 discriminates whether the copying cycles of the set number have been completed. If not the steps S68–S70 are repeated. If said copying cycles have been completed, a step S73 is executed to shift the switching lever 84 to the solid-lined position in FIG. 1 and to activate the automatic feeder motor M3, and a step S74 ejects the original sheet to the tray 74. A step S75 discriminates, by the sensor SS2, whether the original sheet remains on the tray 72, and, if it is present, the program returns through steps S76, S77 to the step S64 for repeating the above-described procedure. When the original sheets on the tray 72 are exhausted, the program proceeds from the step S75 to a step S78 for stopping the automatic feeder motor M3. Then a step S79 executes the post-rotation process, and the program returns through steps S80 and S81 to the step S2 shown in FIG. 8, thus entering the copying stand-by cycle.

In the present embodiment, as explained in the foregoing, in the sampling copy mode selected by the actuation of the sampling button 158, the transfer sheets subjected to the copying process after said selection are guided to the separate tray 92 through the path 47, switching lever 95 and path 98. Consequently the operator can easily confirm the state of image by inspecting the transfer sheets in said tray 92.

Also in the present embodiment, in case the sampling copy mode is selected for a multiple copying operation for making plural copies from an original, the first transfer sheet alone is guided to said tray 92 while the second and succeeding transfer sheets are stored in the proper storage bins 91. Thus, in case the image of the sampled transfer sheet is judged normal, the copying operation is continued without any particular instruction from the operator. The operator is therefore required to actuate the recovery button 152 only in case said image is considered abnormal, so that the efficiency of operation is not lost by the selection of said sampling copy mode.

Furthermore, in the present embodiment, the transfer sheets in the tray 92 can be stored into the proper storage bins 91 in the editing mode, with eventual correction of the order of pages. Therefore the sampled transfer sheets do not require any additional process.

Furthermore, in case the image of thus sampled transfer sheet is judged abnormal, a recovery process is initiated by the actuation of the recovery button 52 to reject the transfer sheets with abnormal images from the storage bins 91 and shred said transfer sheets in the shredder unit 93. It is therefore not necessary for the operator to extract such transfer sheets with abnormal images from the storage bins.

Furthermore, the number of shredded sheets counted by the sensor SS7 can be used for the calculation of the copy charge. It is therefore no longer necessary for the operator to store such failed copy sheets until the calculation of copy charge, and for the servicing person to confirm the number of such failed copy sheets.

The automatic document feeder of the present embodiment is provided with a first tray for bothside copying, a second tray for one-side copying and a third tray for receiving the originals from the second tray and forwarding said originals again to the exposure position, wherein the feed path of the originals is changed according to the copying mode. It is therefore rendered possible to invert the originals in a limited space without the conventional original inverting means such as a rotary drum, and to achieve both-side copying within a short period.

The above-mentioned original trays for the oneside and both-side copying modes are respectively provided with indicator lamps and original detecting means, and the copying operation is prohibited if the originals are not inserted into the tray corresponding to the selected copying mode. In this manner it is possible to completely prevent erroneous copying resulting from erroneous insertion of the originals.

What I claim is:

1. An image forming apparatus comprising:

an original feeding device adapted for feeding originals to a determined position wherein said original feeding means includes first and second original stacking means on which originals are selectively placed for being withdrawn and fed to said determined position by said feeding device;

image forming means adapted for forming images of said originals on recording sheets, and being capable of said image formation in first and second image forming modes, wherein said originals are placed on said first original stacking means for image formation in said first mode, and on said second original stacking means for image formation in said second mode;

selecting means for selecting either said first or said second image forming mode, whrein said selecting means provides an output signal corresponding to the selected mode; and display means coupled to said selecting means for indicating upon which of said first or second original stacking means said originals should be placed, wherein said indication by said display means is in response to the output signal from said selecting means.

2. An image forming apparatus according to claim 1, wherein said first image forming mode is a both-side copying mode for forming images on both sides of the recording sheet, and said second image forming mode is a one-side copying mode for forming an image on one side of the recording sheet.

3. An image forming apparatus according to claim 2, wherein said display means selects and indicates said first original stacking means in response to the selection of said both-side copying mode by said selecting means, and said display means selects and indicates said second original stacking means in response to the selection of said one-side copying mode.

4. An image forming apparatus according to claim 1 or 3, wherein said first original stacking means comprises a first tray for stacking both-side originals, and the originals from said first tray are fed, after copying of the images on one sides thereof, in such a manner as to enable copying of the image on the other sides thereof.

5. An image forming apparatus according to claim 1 or 3, wherein said second original stacking means comprises a second tray for stacking one-side originals, and the originals from said second tray are fed in such a manner as to enable copying of the images on one sides thereof.

6. An image forming apparatus comprising:

image forming means adapted for forming an image on a recording sheet corresponding to an original image at a determined position;

original feeding means for feeding originals to said determined position, wherein said original feeding means comprises:

first original stacking means for stacking both-side originals; second original stacking means for stacking one-side originals; and feeding means for feeding originals from said first or second original stacking means to said determined position; and control means for controlling said feeding means in such a manner as to temporarily store said originals fed from said first original stacking means in said second original stacking means after image formation for the first faces of said originals and to feed said originals again for effecting the image formation for the second faces thereof.

7. An image forming apparatus according to claim 6, wherein said feeding means comprises inverting means adapted to invert, at the feeding of both-side originals, the order of pages of the originals fed from said second original stacking means.

8. An image forming apparatus according to claim 7, wherein said inverting means comprises third original stacking means for stacking the originals fed from said second original stacking means.

9. An image forming apparatus according to claim 6, wherein said control means is adapted to control said feeding means, in a mode for effecting multiple image formations for an original, in such a manner as to feed an original from said first original stacking means, after image formation of a determined number for the first face of said original, to said second original stacking means, and to feed said original from said second original stacking means for effecting image formation for the second face of said original.

10. An image forming apparatus according to claim 6 or 9, wherein said control means is adapted to control said feeding means, in a mode for effecting single image formation for an original, in such a manner as to effect, after the image formation for the first face of said original, image formation for the first face of a succeeding original.

11. An image forming apparatus according to claim 6, wherein said image forming means is adapted to function in a mode to effect image formation on one face of the recording sheet and in another mode for effecting image formation on both faces of the recording sheet.

* * * * *

UNITED STATES PATENT AND TRADEMARK OFFICE

CERTIFICATE OF CORRECTION

PATENT NO. : 4,561,765

DATED : December 31, 1985

INVENTOR(S) : SHUNICHI MASUDA

It is certified that error appears in the above-identified patent and that said Letters Patent is hereby corrected as shown below:

IN THE DRAWINGS

Figures 8, 8A:
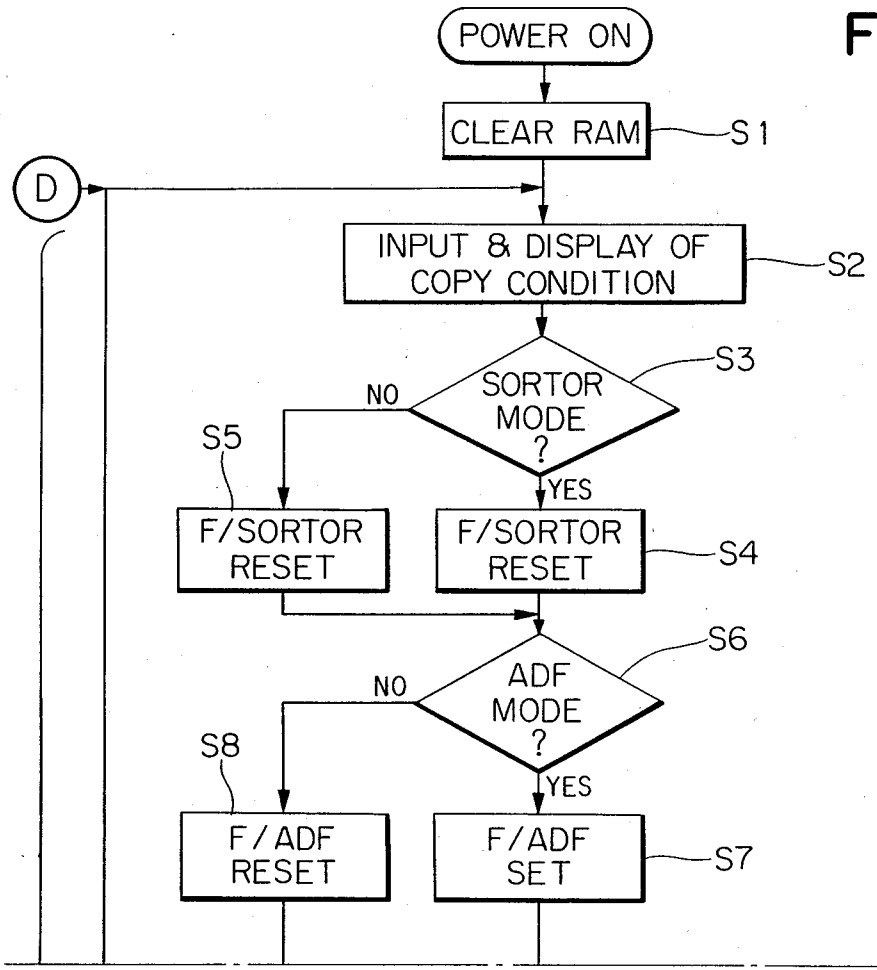
FIG. 8 composed of FIGS. 8A, 8B and 8C to FIG. 14 are flow charts showing the functions of the apparatus shown in FIG. 1.
Figure 8B:
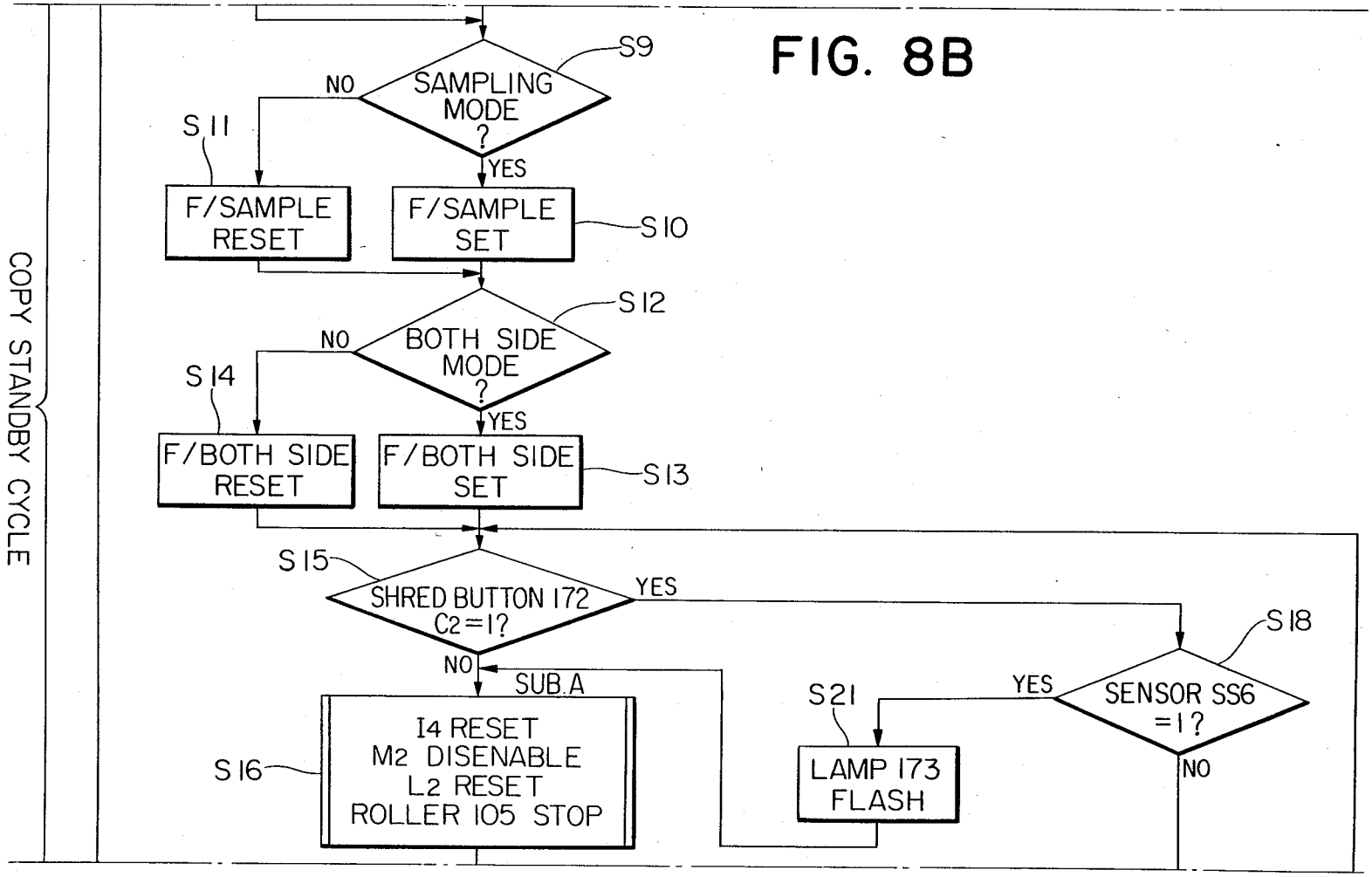
Figure 9B:
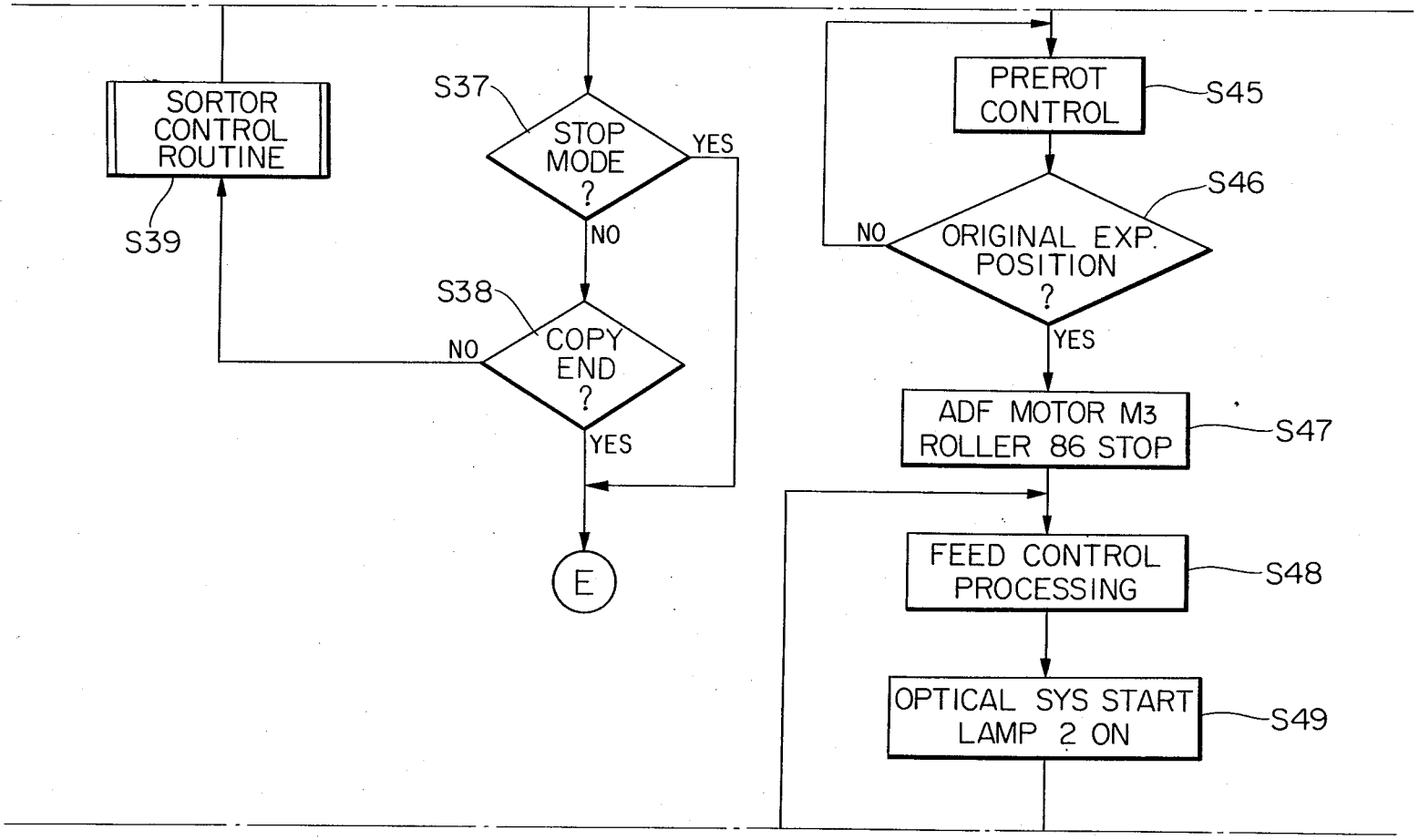
Figures 10, 10A:
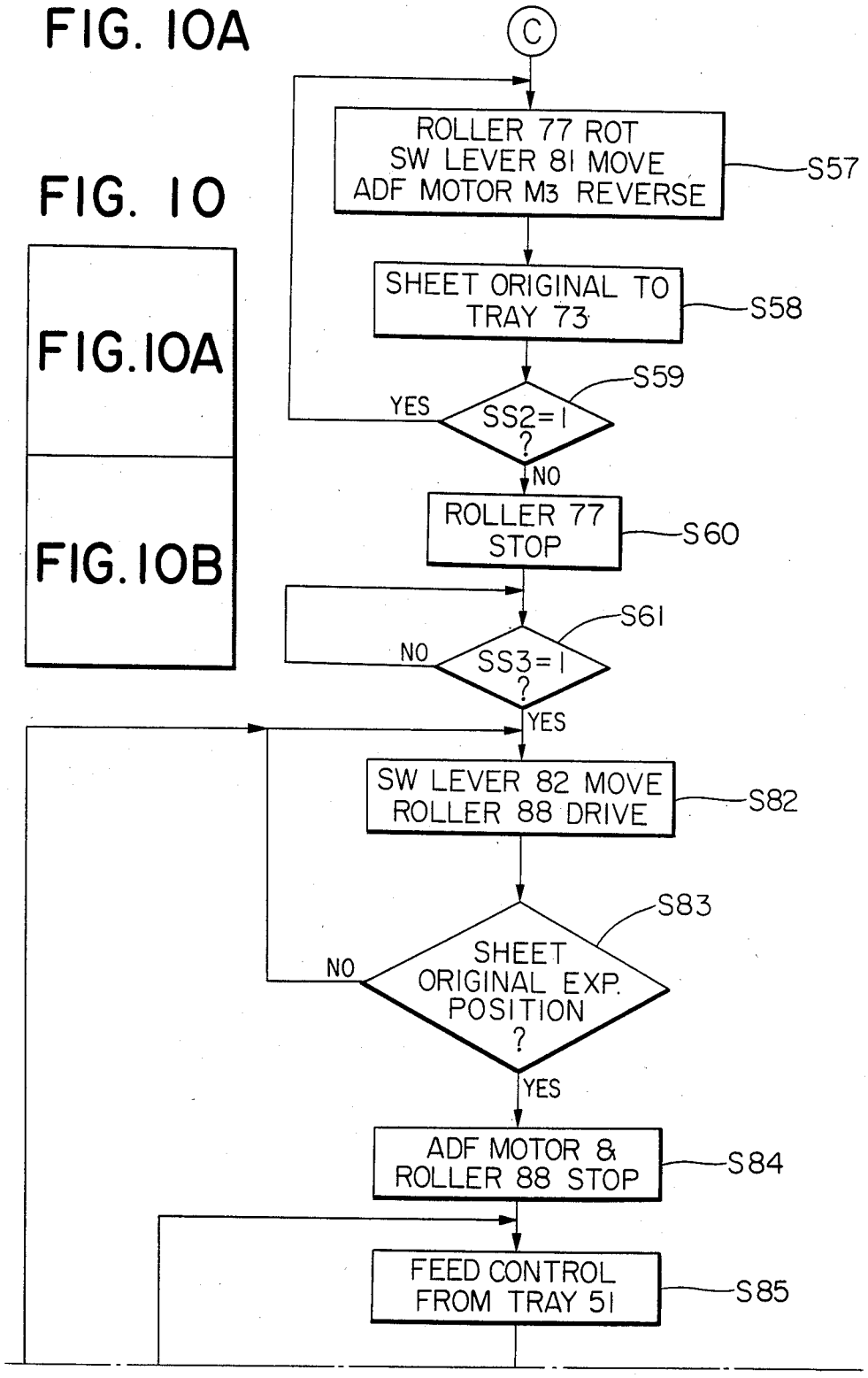
Figure 10B:
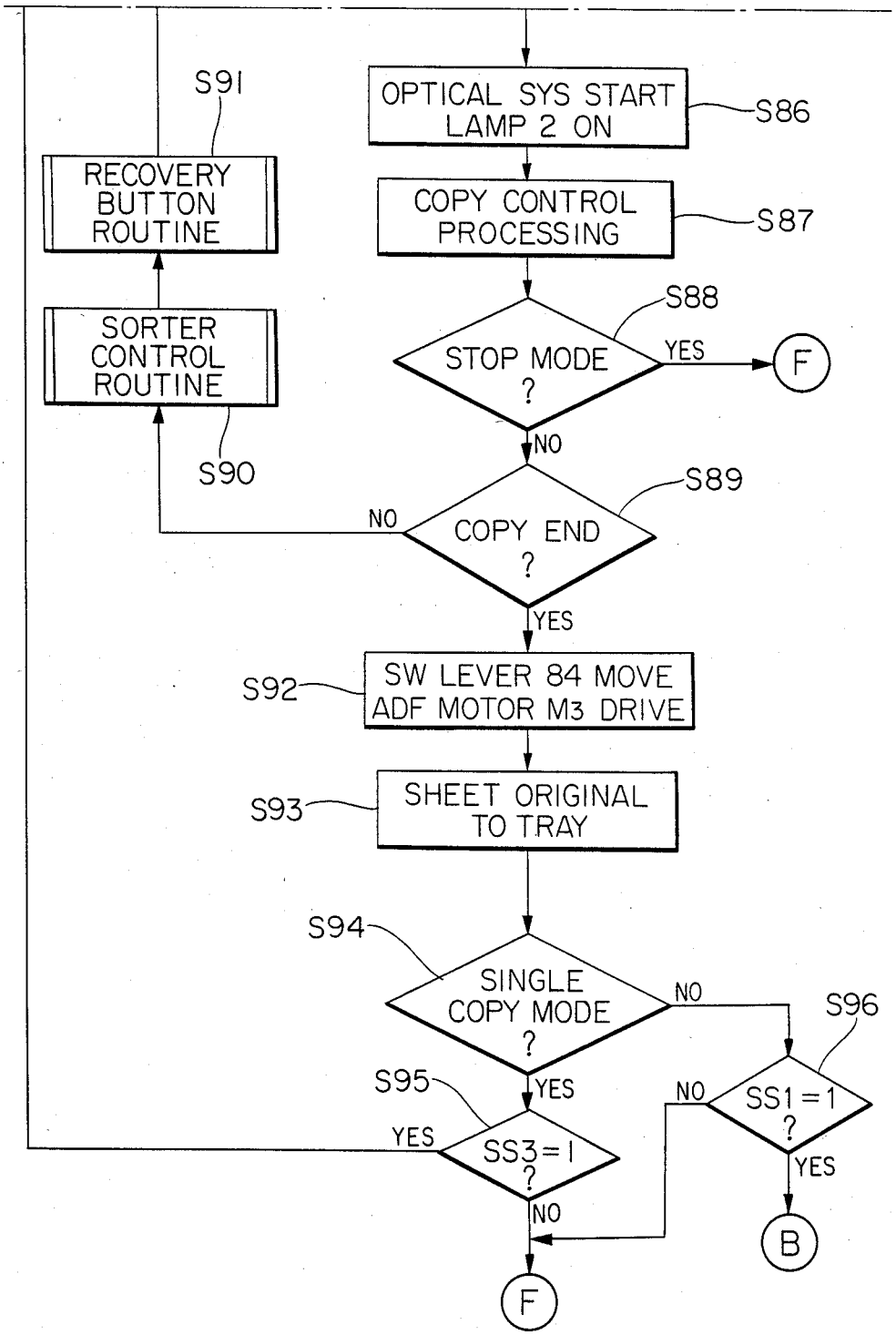
Figure 12A:
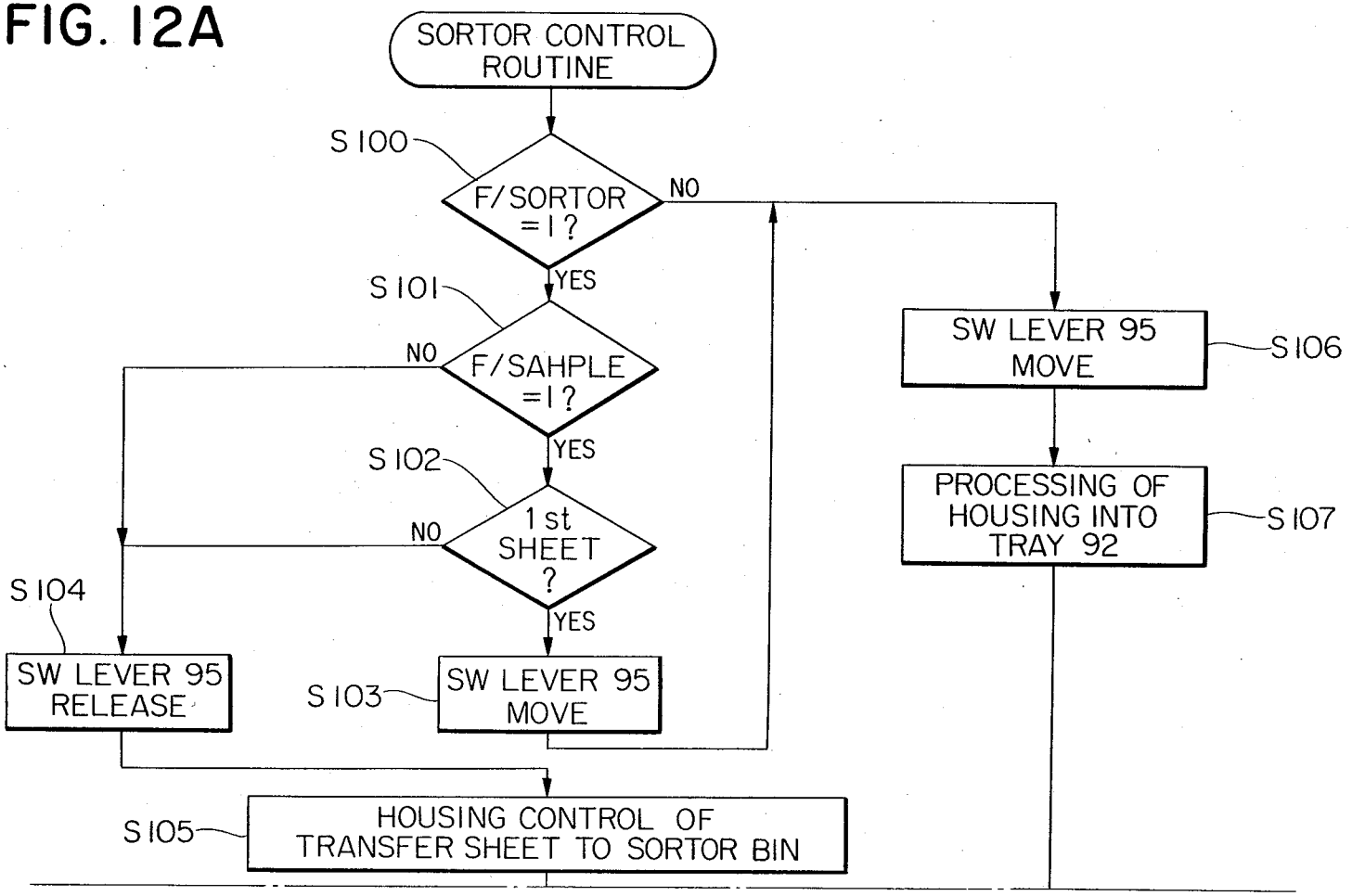

In Fig. 6A (two occurrences), Fig. 8A (three occurrences, Fig. 9B, Fig. 12A (three occurrences), and Fig. 14, "SORTOR" should read --SORTER--.

Figure 6B:
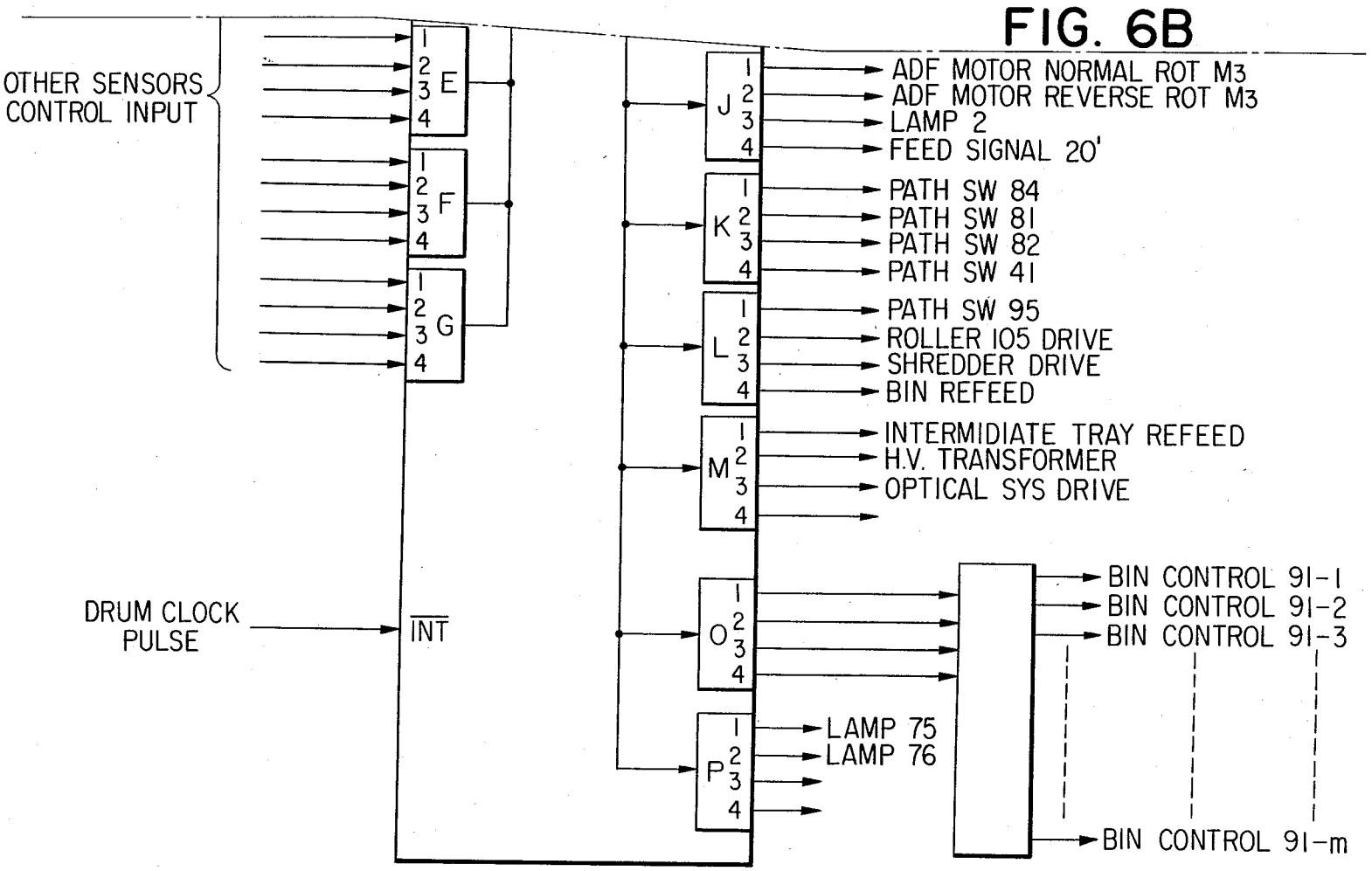

In Fig. 6B, "INTERMIDIATE" should read --INTERMEDIATE--.

Figure 8C:
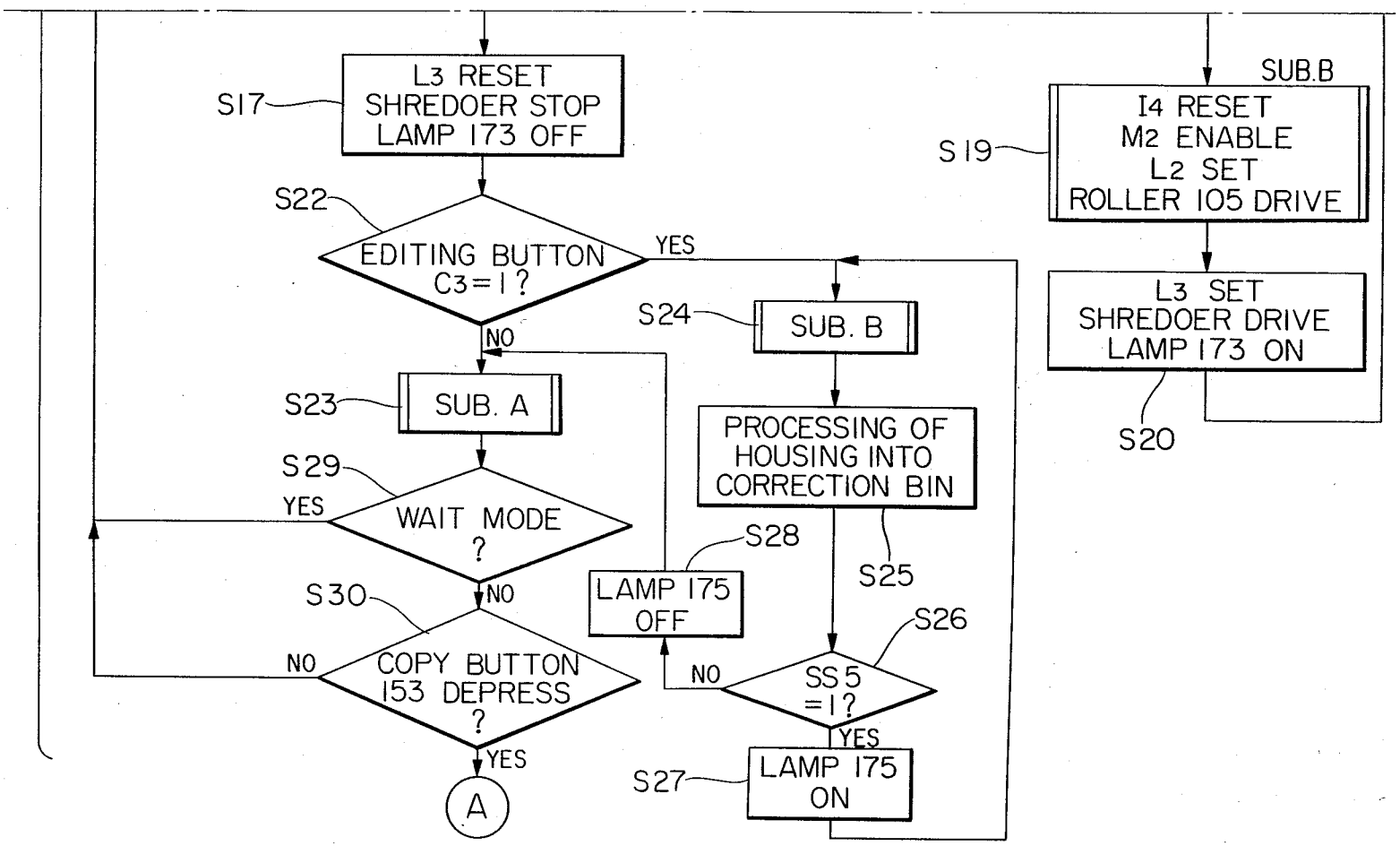

In Fig. 8C, "SHREDOER" (two occurrences) should read --SHREDDER--.

In Fig. 11B, "RECOVERT" should read --RECOVERY--.
"BOUTINE" should read --ROUTINE--.
"ROUTING" should read --ROUTINE--.

In Fig. 12A, "SAHPLE" should read --SAMPLE--.

In Fig. 12B, "TRASNFER" should read --TRANSFER--.

COLUMN 1

Lines 41 and 42, "occuring" should read --occurring--.
Line 53, after "attended" insert --to--.

COLUMN 2

Line 61, after "3,4" insert --,--.

UNITED STATES PATENT AND TRADEMARK OFFICE

CERTIFICATE OF CORRECTION

PATENT NO. : 4,561,765

DATED : December 31, 1985

INVENTOR(S) : SHUNICHI MASUDA

It is certified that error appears in the above-identified patent and that said Letters Patent is hereby corrected as shown below:

COLUMN 3

Line 11, after "3,4" insert --,--.
Line 32, "eliminater" should read --eliminator--.
Line 50, "and" should read --,--.

COLUMN 4

Line 15, "eliminater" should read --eliminator--.

COLUMN 7

Line 50, delete "to a position 936".

COLUMN 10

Line 20, "explained is the copying cycle" should read --, the copying cycle is explained--.

COLUMN 11

Line 36, "stap S40" should read --step S40--.

COLUMN 13

Line 58, "light" should read --lights--.

UNITED STATES PATENT AND TRADEMARK OFFICE

CERTIFICATE OF CORRECTION

PATENT NO. : 4,561,765

DATED : December 31, 1985

INVENTOR(S) : SHUNICHI MASUDA

It is certified that error appears in the above-identified patent and that said Letters Patent is hereby corrected as shown below:

COLUMN 14

Line 37, "button 52" should read --button 152--.
Line 50, "bothside" should read --both-side--.
Line 60, "oneside" should read --one-side--.

COLUMN 15

Line 17, "whrein" should read --wherein--.
Lines 43 and 49, "sides" should read --side--.

Signed and Sealed this

*Twenty-sixth* Day of *August 1986*

[SEAL]

*Attest:*

DONALD J. QUIGG

*Attesting Officer* *Commissioner of Patents and Trademarks*